US010351922B2

(12) United States Patent
Snyder et al.

(10) Patent No.: US 10,351,922 B2
(45) **Date of Patent: *Jul. 16, 2019**

(54) SURFACE HARDENABLE STAINLESS STEELS

(71) Applicant: QuesTek Innovations, LLC, Evanston, IL (US)

(72) Inventors: David R. Snyder, Des Plaines, IL (US); Jiadong Gong, Evanston, IL (US); Jason T. Sebastian, Chicago, IL (US); James A. Wright, Los Gatos, CA (US); Herng-Jeng Jou, San Jose, CA (US); Zechariah Feinberg, Mountain View, CA (US)

(73) Assignee: QuesTek Innovations LLC, Evanston, IL (US)

( * ) Notice: Subject to any disclaimer, the term of this patent is extended or adjusted under 35 U.S.C. 154(b) by 436 days.

This patent is subject to a terminal disclaimer.

(21) Appl. No.: 14/691,956

(22) Filed: Apr. 21, 2015

(65) Prior Publication Data

US 2016/0040262 A1 Feb. 11, 2016

Related U.S. Application Data

(60) Continuation-in-part of application No. 14/574,611, filed on Dec. 18, 2014, which is a (Continued)

(51) Int. Cl.
*C22C 38/00* (2006.01)
*C21D 6/00* (2006.01)
(Continued)

(52) U.S. Cl.
CPC ..... *C21D 8/005* (2013.01); *B22D 7/00* (2013.01); *C21D 1/26* (2013.01); *C21D 6/004* (2013.01);
(Continued)

(58) Field of Classification Search
CPC ..... C21D 8/005; C21D 6/02; C22C 38/50; C22C 38/48; C22C 38/44; C22C 38/42;
(Continued)

(56) References Cited

U.S. PATENT DOCUMENTS 2,926,111 A * 2/1960 Schweitzer ..... C23C 10/22 148/242
4,154,629 A 5/1979 Asai et al.
(Continued)

FOREIGN PATENT DOCUMENTS

DE 2453109 A1 * 5/1975 ..... C22C 38/42
EP 0386673 A1 9/1990
(Continued)

OTHER PUBLICATIONS

Feb. 8, 2016—(PCT)—International Search Report and Written Opinion—App PCT/US2015/027073.
(Continued)

*Primary Examiner* — Kiley S Stoner
(74) *Attorney, Agent, or Firm* — Banner & Witcoff, Ltd.

(57) ABSTRACT

Alloys, a process for preparing the alloys, and manufactured articles including the alloys are described herein. The alloys include, by weight, about 11.5% to about 14.5% chromium, about 0.01% to about 3.0% nickel, about 0.1% to about 1.0% copper, about 0.1% to about 0.2% carbon, about 0.01% to about 0.1% niobium, 0% to about 5% cobalt, 0% to about 3.0% molybdenum, and 0% to about 0.5% titanium, the balance essentially iron and incidental elements and impurities.

4 Claims, 5 Drawing Sheets

Related U.S. Application Data continuation-in-part of application No. 14/462,119, filed on Aug. 18, 2014, which is a division of application No. 12/937,348, filed as application No. PCT/US2009/040351 on Apr. 13, 2009, now Pat. No. 8,808,471.

(60) Provisional application No. 61/044,355, filed on Apr. 11, 2008, provisional application No. 61/983,922, filed on Apr. 24, 2014.

(51) Int. Cl.

| | |
|---|---|
| ***C21D 8/00*** | (2006.01) |
| ***C22C 38/52*** | (2006.01) |
| ***C22C 38/50*** | (2006.01) |
| ***C22C 38/48*** | (2006.01) |
| ***C22C 38/44*** | (2006.01) |
| ***C22C 38/42*** | (2006.01) |
| ***C22C 38/30*** | (2006.01) |
| ***C22C 38/28*** | (2006.01) |
| ***C22C 38/26*** | (2006.01) |
| ***C22C 38/22*** | (2006.01) |
| ***C22C 38/20*** | (2006.01) |
| ***C22C 38/06*** | (2006.01) |
| ***C22C 38/04*** | (2006.01) |
| ***C22C 38/02*** | (2006.01) |
| ***C22C 33/04*** | (2006.01) |
| ***B22D 7/00*** | (2006.01) |
| ***C21D 9/70*** | (2006.01) |
| ***C21D 1/26*** | (2006.01) |
| ***C21D 6/02*** | (2006.01) |
| *C21D 1/28* | (2006.01) |

(52) U.S. Cl.

CPC ..... *C21D 6/005* (2013.01); *C21D 6/007* (2013.01); *C21D 6/008* (2013.01); *C21D 6/02* (2013.01); *C21D 9/70* (2013.01); *C22C 33/04* (2013.01); *C22C 38/001* (2013.01); *C22C 38/002* (2013.01); *C22C 38/02* (2013.01); *C22C 38/04* (2013.01); *C22C 38/06* (2013.01); *C22C 38/20* (2013.01); *C22C 38/22* (2013.01); *C22C 38/26* (2013.01); *C22C 38/28* (2013.01); *C22C 38/30* (2013.01); *C22C 38/42* (2013.01); *C22C 38/44* (2013.01); *C22C 38/48* (2013.01); *C22C 38/50* (2013.01); *C22C 38/52* (2013.01); *C21D 1/28* (2013.01); *C21D 2211/004* (2013.01); *C21D 2211/008* (2013.01)

(58) Field of Classification Search

CPC ..... C22C 38/30; C22C 38/28; C22C 38/26; C22C 38/22; C22C 38/20; C22C 38/06; C22C 38/04

USPC ..... 148/318; 420/8–129

See application file for complete search history.

(56) References Cited

U.S. PATENT DOCUMENTS

| | | | | |
|---|---|---|---|---|
| 4,420,335 | A | 12/1983 | Takagi et al. | |
| 4,659,241 | A | 4/1987 | Bamberger et al. | |
| 5,089,067 | A * | 2/1992 | Schumacher | C22C 38/38 148/325 |
| 5,545,269 | A | 8/1996 | Koo et al. | |
| 5,650,024 | A | 7/1997 | Hasegawa et al. | |
| 5,785,924 | A | 7/1998 | Beguinot et al. | |
| 5,900,075 | A | 5/1999 | Koo et al. | |
| 6,162,389 | A | 12/2000 | Hase et al. | |
| 6,228,183 | B1 | 5/2001 | Bangaru et al. | |
| 6,245,290 | B1 | 6/2001 | Koo et al. | |
| 6,248,191 | B1 | 6/2001 | Luton et al. | |
| 6,264,760 | B1 | 7/2001 | Tamehiro et al. | |
| 6,764,647 | B2 | 7/2004 | Aigner et al. | |
| 6,793,744 | B1 * | 9/2004 | Jung | C22C 38/001 148/325 |
| 7,070,663 | B2 | 7/2006 | Suzuki et al. | |
| 7,186,304 | B2 | 3/2007 | Chin et al. | |
| 7,887,645 | B1 | 2/2011 | Schoen et al. | |
| 8,715,432 | B2 | 5/2014 | Hasegawa et al. | |
| 2002/0139449 | A1 | 10/2002 | Goecmen | |
| 2002/0164260 | A1 * | 11/2002 | Koga | C22C 38/001 420/61 |
| 2003/0192626 | A1 * | 10/2003 | Takiguchi | C22C 38/60 148/405 |
| 2004/0096351 | A1 | 5/2004 | Suzuki et al. | |
| 2004/0191109 | A1 | 9/2004 | Maziasz et al. | |
| 2006/0021682 | A1 | 2/2006 | Saha et al. | |
| 2006/0060270 | A1 | 3/2006 | Klueh et al. | |
| 2006/0096671 | A1 | 5/2006 | Sano et al. | |
| 2006/0163231 | A1 * | 7/2006 | Kobayashi | B23K 35/308 219/146.23 |
| 2007/0000576 | A1 | 1/2007 | Blanke | |
| 2008/0138233 | A1 * | 6/2008 | Tomita | C21D 6/002 420/61 |
| 2008/0251166 | A1 | 10/2008 | Han | |
| 2009/0194175 | A1 | 8/2009 | Gerceker et al. | |
| 2009/0277539 | A1 | 11/2009 | Kimura et al. | |
| 2009/0291014 | A1 * | 11/2009 | Vartanov | C21D 6/004 420/91 |
| 2009/0324441 | A1 * | 12/2009 | Weiss | C21D 8/005 420/44 |
| 2011/0024003 | A1 * | 2/2011 | Vartanov | C21D 1/25 148/327 |
| 2012/0031529 | A1 * | 2/2012 | Ohishi | C21D 6/02 148/318 |
| 2016/0040262 | A1 | 2/2016 | Snyder et al. | |

FOREIGN PATENT DOCUMENTS

| | | | | |
|---|---|---|---|---|
| EP | 1158065 | A1 | 11/2001 | |
| EP | 1602744 | B1 | 3/2009 | |
| FR | 2700174 | A1 * | 7/1994 | B62K 19/04 |
| GB | 678616 | A * | 9/1952 | C22C 38/52 |
| WO | WO 9102827 | A1 * | 3/1991 | C21D 8/005 |
| WO | 9840180 | A1 | 9/1998 | |
| WO | WO 2005014873 | A1 * | 2/2005 | C22C 38/02 |
| WO | WO 2008123159 | A1 * | 10/2008 | C21D 6/004 |
| WO | 2009126954 | A2 | 10/2009 | |
| WO | WO 2010149561 | A1 * | 12/2010 | C21D 1/06 |

OTHER PUBLICATIONS

Jun. 21, 2017—U.S. Non-Final Office Action—U.S. Appl. No. 14/462,119.

Jun. 22, 2017—U.S. Non-Final Office Action—U.S. Appl. No. 14/574,611.

* cited by examiner

SURFACE HARDENABLE STAINLESS STEELS

CROSS-REFERENCE TO RELATED APPLICATIONS

This application claims priority to U.S. Provisional Application No. 61/983,922, filed Apr. 24, 2014, and is herein incorporated by reference in its entirety. This application is also a continuation-in-part which claims priority to and the benefit of U.S. patent application Ser. No. 14/574,611, filed Dec. 18, 2014; which is a continuation-in-part of U.S. patent application Ser. No. 14/462,119 filed Aug. 18, 2014; which is a division of U.S. patent application Ser. No. 12/937,348 filed Nov. 29, 2010, now U.S. Pat. No. 8,808,471 issued Aug. 19, 2014; which is a national stage application of PCT Application No. PCT/US2008/40351 filed Apr. 13, 2009, which is the non-provisional of and claims priority to provisional U.S. Patent Application No. 61/044,355 filed Apr. 11, 2008, all of which are incorporated by reference herein in their entireties.

STATEMENT OF GOVERNMENT INTEREST

This invention was made with government support under Contract No. M67854-OS-C-0025 awarded by the U.S. Marine Corps Systems Command, and Contract Nos. N68335-12-C-0248 and N68335-13-C-0280, awarded by the U.S. Navy. The government has certain rights in the invention.

BACKGROUND

The material properties of secondary-hardened carbon stainless steels are often limited by cementite precipitation during aging. Because the cementite is enriched with alloying elements, it becomes more difficult to fully dissolve the cementite as the alloying content of elements such as chromium increases. Undissolved cementite in the steel can limit toughness, reduce strength by gettering carbon, and act as corrosion pitting sites.

Cementite precipitation could be substantially suppressed in stainless steels by substituting nitrogen for carbon. There are generally two ways of using nitrogen in stainless steels for strengthening: (1) solution-strengthening followed by cold work; or (2) precipitation strengthening. Cold worked alloys are not generally available in heavy cross-sections and are also not suitable for components requiring intricate machining. Therefore, precipitation strengthening is often preferred to cold work. Precipitation strengthening is typically most effective when two criteria are met: (1) a large solubility temperature gradient in order to precipitate significant phase fraction during lower-temperature aging after a higher-temperature solution treatment, and (2) a fine-scale dispersion achieved by precipitates with lattice coherency to the matrix.

These two criteria are difficult to meet in conventional nitride-strengthened martensitic steels. The solubility of nitrogen is very low in the high-temperature bcc-ferrite matrix, and in austenitic steels, nitrides such as M2N are not coherent with the fcc matrix. Thus, there has developed a need for a martensitic steel strengthened by nitride precipitates.

Stainless steel alloys are commonly used in structural applications demanding high strength, ductility and corrosion resistance. Specifically, high-performance, stainless bearing steel is needed to achieve long life and efficient operation of aerospace drive system turbine machinery operating in a corrosive environment. For example, vertical take-off and landing lift-systems in modern jet turbine engines have gears and bearings that are often subject to moist air. Compared to most gearbox assemblies, these lift-system gearbox assemblies are not in service long enough to ensure all of the moisture is driven off during operation due to heat. As a result, condensation results in corrosion, especially on carburized surfaces. Available aerospace gear alloys such as 440C, AMS 6308, 9310 (AMS 6256), FERRIUM® C61 (AMS 6517), and FERRIUM® C64 (AMS 6509) have limited corrosion resistance. Other options may also provide some level of corrosion resistance, such as in PYROWEAR® 675 (AMS 5930), but corrosion resistance is compromised due to a suboptimal case carburized microstructure and low matrix chromium content. It would be advantageous to develop a fully stainless, surface hardenable steel alloy alternative with improved corrosion resistance and enhanced bearing performance.

SUMMARY

In one aspect, disclosed is an alloy comprising, by weight, about 11.5% to about 14.5% chromium, about 0.1% to about 3.0% nickel, about 0.1% to about 1.0% copper, about 0.1% to about 0.3% carbon, about 0.01% to about 0.1% niobium, 0% to about 5% cobalt, 0% to about 3.0% molybdenum, and 0% to about 0.5% titanium, the balance essentially iron and incidental elements and impurities.

In another aspect, disclosed is an alloy comprising, by weight, about 12.0% to about 14.1% chromium, about 0.3% to about 1.7% nickel, about 0.2% to about 0.5% copper, about 0.1% to about 0.2% carbon, about 0.04% to about 0.06% niobium, 0% to about 3.0% cobalt, 0% to about 1.5% molybdenum, and 0% to about 0.1% titanium, the balance essentially iron and incidental elements and impurities.

In another aspect, disclosed is an alloy produced by a process comprising: preparing a melt that includes, by weight, 12.0% to about 14.1% chromium, about 0.3% to about 1.7% nickel, about 0.2% to about 0.5% copper, about 0.1% to about 0.2% carbon, about 0.04% to about 0.06% niobium, 0% to about 3.0% cobalt, 0% to about 1.5% molybdenum, and 0% to about 0.1% titanium, the balance essentially iron and incidental elements and impurities; wherein the melt is produced by Vacuum Induction Melting (VIM) followed by Vacuum Arc Remelting (VAR) into ingots; homogenizing the ingots at 1100° C. for 24 hours; homogenizing the ingots at 1150° C. for 24 hours; hot rolling the ingots at 1150° C. into plates of specified thickness; normalizing the hot rolled plates at 1000° C. for 1 hour; treating with cooling air; annealing at 625° C. for 8 hours; and cooling to room temperature in air.

In another aspect, disclosed is a manufactured article comprising an alloy that includes, by weight, about 12.0% to about 14.1% chromium, about 0.3% to about 1.7% nickel, about 0.2% to about 0.5% copper, about 0.1% to about 0.2% carbon, about 0.04% to about 0.06% niobium, 0% to about 3.0% cobalt, 0% to about 1.5% molybdenum, and 0% to about 0.1% titanium, the balance essentially iron and incidental elements and impurities.

DETAILED DESCRIPTION

Figure 1:
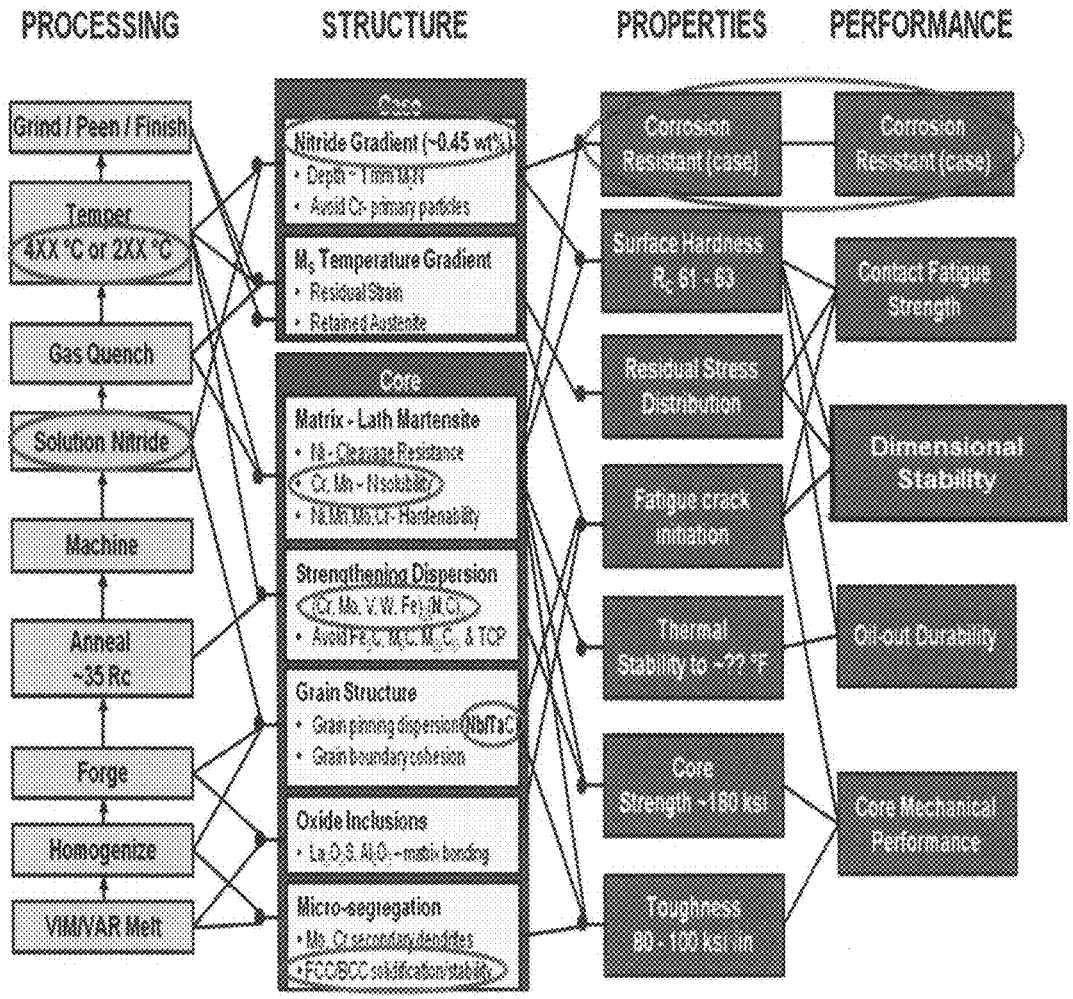
FIG. 1 is a systems-design chart illustrating processing-structure-property relationships of exemplary stainless steel-based alloys.

Disclosed are stainless steel alloys, methods for making the alloys, and manufactured articles comprising the alloys. The alloys exhibit improved physical properties relative to existing stainless steel alloys. For example, the stainless steel alloys can have high strength, high surface hardness, corrosion resistance, and enhanced manufacturability.

Fully stainless, surface hardenable, corrosion-resistant steel alloys were achieved by relying on nano-scale metal carbide and metal nitride secondary hardening. Design of the alloys was based upon providing a high chromium martensitic steel specifically configured for solution nitriding, with only a minimal fraction of chromium-free primary carbides for grain-pinning.

While conventional secondary hardened steels typically utilize a high cobalt content to promote secondary hardening, the disclosed alloys employ body centered cubic copper (bcc-Cu) precipitation to promote secondary hardening. This greatly reduces raw material costs of the process. Furthermore, the copper content can be computationally optimized to ensure high nitrogen solubility.

In addition, the disclosed alloys utilize dispersion of niobium and titanium carbide for grain pinning, resulting in optimal grain size control. To optimize corrosion resistance, dispersion of these carbides can be computationally optimized and specially processed to avoid primary nitride formation during solution nitriding.

The strengthening phase (in both case and core) of these alloys is the formation of $M_2X$ (M=Cr, Mo, Co, Fe; X=C, N). The driving force for precipitation of these carbides and nitrides is improved by utilizing copper precipitation as a nucleant to the carbide/nitride precipitation. This allows for minimal cobalt content and more efficient use of alloying content. In turn, these features contribute to the corrosion resistant properties of the disclosed alloys, which are achieved via high chromium content, while avoiding primary carbides and nitrides that are chromium rich and deplete the surrounding alloy matrix of chromium content.

High nitrogen solubility is provided to ensure high surface hardness. A high delta-ferrite solvus temperature is provided to maintain sufficient austenite phase region for optimal solution nitridability, good homogenization and good forging windows. Studies revealed that chromium, manganese, and molybdenum are beneficial to nitrogen solubility, while nickel, cobalt, copper, and carbon are detrimental. Studies also determined that chromium, molybdenum, and copper increase the stability of delta-ferrite, which limits the processability of the alloy by reducing the stability of austenite. However, alloying elements needed to improve the stability of austenite (and destabilize delta-ferrite), such as nickel, cobalt and carbon are detrimental to nitrogen solubility. Alloying content is thus preferably controlled to balance these effects and to yield alloys with both high nitrogen solubility and high austenite stability. From the preceding analysis, copper is a non-intuitive alloying addition because it is detrimental to both nitrogen solubility and austenite stability.

The compositions of the disclosed alloys are configured to balance the delicate interplay between the stability of high-temperature austenite and delta ferrite. The alloys are also configured to balance martensite transformation kinetics and nitrogen solubility, so that high surface hardenability is ensured. These properties are also balanced with corrosion resistance, strength and ductility to provide adequate thermal processing windows. As such, the disclosed alloys are designed for a combination of high nitrogen solubility, high delta-ferrite solvus temperature and high case martensite temperature. Such alloys can be useful for manufacture of articles including, but not limited to, aircraft engine bearings and lift fan gearbox bearings. The alloys can be useful for numerous other applications, particularly where a stainless steel alloy with a martensitic core that has a corrosion-resistant hardened case is desired. As illustrated in FIG. 1, a set of suitable alloy properties can be selected depending on the desired performance of the manufactured article.

I. DEFINITIONS OF TERMS

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used in practice or testing of the present invention. All publications, patent applications, patents and other references mentioned herein are incorporated by reference in their entirety. The materials, methods, and examples disclosed herein are illustrative only and not intended to be limiting.

As used in the specification and the appended claims, the singular forms "a," "and" and "the" include plural references unless the context clearly dictates otherwise. The terms "comprise(s)," "include(s)," "having," "has," "can," "contain(s)," and variants thereof, as used herein, are intended to be open-ended transitional phrases, terms, or words that do not preclude the possibility of additional acts or structures. The present disclosure also contemplates other embodiments "comprising," "consisting of" and "consisting essentially of," the embodiments or elements presented herein, whether explicitly set forth or not.

The conjunctive term "or" includes any and all combinations of one or more listed elements associated by the conjunctive term. For example, the phrase "an apparatus comprising A or B" may refer to an apparatus including A where B is not present, an apparatus including B where A is not present, or an apparatus where both A and B are present. The phrases "at least one of A, B, . . . and N" or "at least one of A, B, . . . N, or combinations thereof" are defined in the broadest sense to mean one or more elements selected from the group comprising A, B, . . . and N, that is to say, any combination of one or more of the elements A, B, . . . or N including any one element alone or in combination with one or more of the other elements which may also include, in combination, additional elements not listed.

The modifier "about" used in connection with a quantity is inclusive of the stated value and has the meaning dictated by the context (for example, it includes at least the degree of error associated with the measurement of the particular quantity). The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number. For example, "about 10%" may indicate a range of 9% to 11%, and "about 1" may mean from 0.9-1.1. Other meanings of "about" may be apparent from the context, such as rounding off, so, for example "about 1" may also mean from 0.5 to 1.4.

Any recited range described herein is to be understood to encompass and include all values within that range, without the necessity for an explicit recitation.

II. ALLOYS

The disclosed alloys may comprise chromium, nickel, copper, nitrogen, carbon, nibium, cobalt, molybdenum, titanium, and iron along with incidental elements and impurities.

The alloys may comprise, by weight, 11.5% to about 14.5% chromium, about 0.1% to about 3.0% nickel, about 0.1% to about 1.0% copper, about 0.1% to about 0.3% carbon, about 0.01% to about 0.1% niobium, 0% to about 5% cobalt, 0% to about 3.0% molybdenum, and 0% to about 0.5% titanium, the balance essentially iron and incidental elements and impurities. It is understood that the alloys described herein may consist only of the above-mentioned constituents or may consist essentially of such constituents, or in other embodiments, may include additional constituents.

The alloys may have a microstructure substantially free of cementite carbides and comprising a martensite matrix with nanoscale copper particles and alloy nitride precipitates selected from the group consisting of alloy nitride precipitates enriched with a transition metal nucleated on the copper precipitates, said alloy nitride precipitates having a hexagonal structure, said alloy nitride precipitates including one or more alloying elements selected from the group Fe, Ni, Cr, Co and Mn coherent with the matrix, and said alloy nitride precipitates having two dimensional coherency with the matrix, said alloy substantially free of cementite carbide precipitates, in the form of a case hardened article of manufacture.

The alloys may comprise, by weight, about 12.0% to about 14.1% chromium, about 0.3% to about 1.7% nickel, about 0.2% to about 0.5% copper, about 0.1% to about 0.2% carbon, about 0.04% to about 0.06% niobium, 0% to about 3.0% cobalt, 0% to about 1.5% molybdenum, and 0% to about 0.1% titanium, the balance essentially iron and incidental elements and impurities.

The alloys may comprise, by weight, about 10.0% to about 14.5% chromium, about 11.5% to about 14.5% chromium, about 12.0% to about 14.5% chromium, about 12.0% to about 14.1% chromium, about 12.5% to about 14.1% chromium, about 12.4% to about 14.1% chromium, about 12.5% to about 13.0% chromium, about 13.0% to about 13.5% chromium, about 12.5% to about 12.6% chromium, or about 13.4% to about 13.5% chromium. The alloys may comprise, by weight, 11.5% to 14.5% chromium, 12.0% to 14.5% chromium, 12.0% to 14.1% chromium, 12.4% to 14.1% chromium, 12.5% to 13.5% chromium, 12.5% to 13.0% chromium, 13.0% to 13.5% chromium, 12.5% to 12.6% chromium, or 13.4% to 13.5% chromium. The alloys may comprise, by weight, 11.5%, 11.6%, 11.7%, 11.8%, 11.9%, 12.0%, 12.1%, 12.2%, 12.3%, 12.4%, 12.5%, 12.6%, 12.7%, 12.8%, 12.9%, 13.0%, 13.1%, 13.2%, 13.3%, 13.4%, 13.5%, 13.6%, 13.7%, 13.8%, 13.9%, 14.0%, 14.1%, 14.2%, 14.3%, 14.4%, or 14.5% chromium. The alloys may comprise, by weight, about 11.5% chromium, about 12.0% chromium, about 12.4% chromium, about 12.5% chromium, about 12.9% chromium, about 13.0% chromium, about 13.5% chromium, about 13.9% chromium, about 14.0% chromium, about 14.1% chromium, or about 14.5% chromium.

The alloys may comprise, by weight, about 0.1% to about 7.5% nickel, about 0.3% to about 7.5% nickel, about 0.1% to about 3% nickel, about 0.3% to about 3% nickel, about 0.4% to about 3% nickel, about 1.2% to about 3% nickel, about 1.3% to about 3% nickel, about 1.4% to about 3% nickel, about 1.7% to about 3% nickel, about 0.3% to about 1.7% nickel, about 0.4% to about 1.7% nickel, about 1.2% to about 1.7% nickel, about 1.3% to about 1.7% nickel, or about 1.5% to about 1.7% nickel. The alloys may comprise, by weight, 0.1% to 3% nickel, 0.3% to 3% nickel, 0.4% to 3% nickel, 1.2% to 3% nickel, 1.3% to 3% nickel, 1.4% to 3% nickel, 1.7% to 3% nickel, 0.3% to 1.7% nickel, 0.4% to 1.7% nickel, 1.2% to 1.7% nickel, 1.3% to 1.7% nickel, 1.4% to 1.7% nickel, or 1.5% to 1.7% nickel. The alloys may comprise, by weight, 0.1%, 0.2%, 0.31%, 0.32%, 0.33%, 0.34%, 0.35%, 0.36%, 0.37%, 0.38%, 0.39%, 0.4%, 0.5%, 0.6%, 0.7%, 0.8%, 0.9%, 1.0%, 1.1%, 1.2%, 1.3%, 1.4%, 1.5%, 1.6%, 1.7%, 1.8%, 1.9%, 2.0%, 2.1%, 2.2%, 2.3%, 2.4%, 2.5%, 2.6%, 2.7%, 2.8%, 2.9%, or 3.0% nickel. The alloys may comprise, by weight, about 0.1% nickel, about 0.3% nickel, about 0.4% nickel, about 1.2% nickel, about 1.3% nickel, about 1.4% nickel, about 1.5% nickel, about 1.7% nickel, or about 3.0% nickel.

The alloys may comprise, by weight, about 0.1% to about 2.3% copper, about 0.25% to about 2.3% copper, about 0.1% to about 1.0% copper, about 0.3% to about 1.0% copper, about 0.3% to about 0.5% copper, about 0.3% to about 0.4% copper, about 0.4% to about 0.5% copper, about 0.3% to about 0.35% copper, or about 0.45% to about 0.5% copper. The alloys may comprise, by weight, 0.1% to 1.0% copper, 0.3% to 1.0% copper, 0.3% to 0.5% copper, 0.3% to 0.4% copper, 0.4% to 0.5% copper, 0.3% to 0.35% copper, or 0.45% to 0.5% copper. The alloys may comprise, by weight, 0.1%, 0.11%, 0.12%, 0.13%, 0.14%, 0.15%, 0.16%, 0.17%, 0.18%, 0.19%, 0.2%, 0.21%, 0.22%, 0.23%, 0.24%, 0.25%, 0.26%, 0.27%, 0.28%, 0.29%, 0.3%, 0.31%, 0.32%, 0.33%, 0.34%, 0.35%, 0.36%, 0.37%, 0.38%, 0.39%, 0.4%, 0.41%, 0.42%, 0.43%, 0.44%, 0.45%, 0.46%, 0.47%, 0.48%, 0.49%, 0.5%, 0.51%, 0.52%, 0.53%, 0.54%, 0.55%, 0.56%, 0.57%, 0.58%, 0.59%, 0.6%, 0.61%, 0.62%, 0.63%, 0.64%, 0.65%, 0.66%, 0.67%, 0.68%, 0.69%, 0.7%, 0.71%, 0.72%, 0.73%, 0.74%, 0.75%, 0.76%, 0.77%, 0.78%, 0.79%, 0.8%, 0.81%, 0.82%, 0.83%, 0.84%, 0.85%, 0.86%, 0.87%, 0.88%, 0.89%, 0.9%, 0.91%, 0.92%, 0.93%, 0.94%, 0.95%, 0.96%, 0.97%, 0.98%, 0.99%, or 1.0% copper. The alloys may comprise, by weight, about 0.1% copper, about 0.2% copper, about 0.3% copper, about 0.4% copper, about 0.5% copper, about 0.6% copper, or about 1.0% copper.

The alloys may comprise, by weight, 0% to about 0.3% carbon, 0% to about 0.2% carbon, about 0.1% to about 0.3% carbon, about 0.12% to about 0.3% carbon, about 0.14% to about 0.3% carbon, about 0.15% to about 0.3% carbon, about 0.1% to about 0.2% carbon, about 0.12% to about 0.2% carbon, about 0.14% to about 0.2% carbon, or about 0.15% to about 0.2% carbon. The alloys may comprise, by weight, 0.1% to 0.2% carbon, 0.12% to 0.2% carbon, 0.14% to 0.2% carbon, 0.15% to 0.2% carbon, 0.1% to 0.3% carbon, 0.12% to 0.3% carbon, 0.14% to 0.3% carbon, or 0.15% to 0.3% carbon. The alloys may comprise, by weight, 0.1%, 0.11%, 0.12%, 0.13%, 0.14%, 0.15%, 0.16%, 0.17%, 0.18%, 0.19%, 0.2%, 0.21%, 0.22%, 0.23%, 0.24%, 0.25%, 0.26%, 0.27%, 0.28%, 0.29%, or 0.3% carbon. The alloys may comprise, by weight, about 0.1% carbon, about 0.12% carbon, about 0.14% carbon, about 0.15% carbon, or about 0.2% carbon.

The alloys may comprise, by weight, about 0.01% to about 0.1% niobium, about 0.04% to about 0.1% niobium, about 0.06% to about 0.1% niobium, about 0.04% to about 0.06% niobium, about 0.04% to about 0.05% niobium, or about 0.05% to about 0.06% niobium. The alloys may comprise, by weight, 0.01% to 0.1% niobium, 0.04% to 0.1% niobium, 0.06% to 0.1% niobium, 0.04% to 0.06% niobium, 0.04% to 0.05% niobium, or 0.05% to 0.06% niobium. The alloys may comprise, by weight, 0.01%, 0.02%, 0.03%, 0.03%, 0.031%, 0.032%, 0.033%, 0.034%, 0.035%, 0.036%, 0.037%, 0.038%, 0.039%, 0.04%, 0.041%, 0.042%, 0.043%, 0.044%, 0.045%, 0.046%, 0.047%, 0.048%, 0.049%, 0.05%, 0.051%, 0.052%, 0.053%, 0.054%, 0.055%, 0.056%, 0.057%, 0.058%, 0.059%, 0.06%, 0.061%, 0.062%, 0.063%, 0.064%, 0.065%, 0.066%, 0.067%, 0.068%, 0.069%, 0.07%, 0.08%, 0.09%, or 0.1% niobium. The alloys may comprise, by weight, about 0.04% niobium, about 0.05% niobium, about 0.06% niobium, or about 0.1% niobium.

The alloys may comprise, by weight, 0% to about 17% cobalt, 0% to about 5% cobalt, 0% to about 3.0% cobalt, about 1.7% to about 5% cobalt, about 2.8% to about 5% cobalt, about 3.0% to about 5% cobalt, about 1.6% to about 3.0% cobalt, or about 2.8% to about 3.0% cobalt. The alloys may comprise, by weight, 0% to 5% cobalt, 0% to 3.0% cobalt, 1.7% to 5% cobalt, 2.8% to 5% cobalt, 3.0% to 5% cobalt, 1.6% to 3.0% cobalt, or 2.8% to 3.0% cobalt. The alloys may comprise, by weight, 0.01%, 0.05%, 0.1%, 0.2%, 0.3%, 0.4%, 0.5%, 0.6%, 0.7%, 0.8%, 0.9%, 1.0%, 1.1%, 1.2%, 1.3%, 1.4%, 1.5%, 1.6%, 1.7%, 1.8%, 1.9%, 2.0%, 2.1%, 2.2%, 2.3%, 2.4%, 2.5%, 2.6%, 2.7%, 2.8%, 2.9%, 3.0%, 3.1%, 3.2%, 3.3%, 3.4%, 3.5%, 3.6%, 3.7%, 3.8%, 3.9%, 4.0%, 4.1%, 4.2%, 4.3%, 4.4%, 4.5%, 4.6%, 4.7%, 4.8%, 4.9%, or 5.0% cobalt. The alloys may comprise, by weight, about 1.6% cobalt, about 2.8% cobalt, about 3.0% cobalt, about 4.0% cobalt, or about 5% cobalt.

The alloys may comprise, by weight, 0% to about 3% molybdenum, about 0.02% to about 3% molybdenum, about 0.9% to about 3% molybdenum, about 1.3% to about 3% molybdenum, about 1.5% to about 3% molybdenum, 0% to about 1.5% molybdenum, about 0.02% to about 1.5% molybdenum, about 0.9% to about 1.5% molybdenum, about 0.6% to about 1.5% molybdenum, or about 1.3% to about 1.5% molybdenum. The alloys may comprise, by weight, 0% to 3% molybdenum, 0.02% to 3% molybdenum, 0.9% to 3% molybdenum, 1.3% to 3% molybdenum, 1.5% to 3% molybdenum, 0% to 1.5% molybdenum, 0.02% to 1.5% molybdenum, 0.9% to 1.5% molybdenum, or 1.3% to 1.5% molybdenum. The alloys may comprise, by weight, 0.01%, 0.02%, 0.03%, 0.04%, 0.05%, 0.06%, 0.07%, 0.08%, 0.09%, 0.1%, 0.2%, 0.3%, 0.4%, 0.5%, 0.6%, 0.7%, 0.8%, 0.9%, 1.0%, 1.1%, 1.2%, 1.3%, 1.4%, 1.5%, 1.6%, 1.7%, 1.8%, 1.9%, 2.0%, 2.1%, 2.2%, 2.3%, 2.4%, 2.5%, 2.6%, 2.7%, 2.8%, 2.9%, or 3.0% molybdenum. The alloys may comprise, by weight, about 0.02% molybdenum, about 0.9% molybdenum, about 1.3% molybdenum, about 1.5% molybdenum, or about 3.0% molybdenum.

The alloys may comprise, by weight, 0% to about 0.5% titanium, 0% to about 0.15% titanium, 0% to about 0.1% titanium, about 0.006% to about 0.002% titanium, about 0.008% to about 0.002% titanium, about 0.006% to about 0.015% titanium, about 0.008% to about 0.015% titanium, about 0.012% to about 0.015% titanium, about 0.013% to about 0.015% titanium, about 0.05% to about 0.15% titanium, or about 0.05% to about 0.1% titanium. The alloys may comprise, by weight, 0% to 0.5% titanium, 0% to 0.15% titanium, 0% to 0.1% titanium, 0.006% to 0.002% titanium, 0.008% to 0.002% titanium, 0.006% to 0.015% titanium, 0.008% to 0.015% titanium, 0.012% to 0.015% titanium, 0.013% to 0.015% titanium, 0.05% to 0.15% titanium, or 0.05% to 0.1% titanium. The alloys may comprise, by weight, 0.005%, 0.006%, 0.007%, 0.008%, 0.009%, 0.01%, 0.011%, 0.012%, 0.013%, 0.014%, 0.015%, 0.016%, 0.017%, 0.018%, 0.019%, 0.02%, 0.03%, 0.04%, 0.05%, 0.06%, 0.07%, 0.08%, 0.09%, 0.1%, 0.11%, 0.12%, 0.13%, 0.14%, or 0.15% titanium. The alloys may comprise, by weight, 0% titanium, about 0.006% titanium, about 0.008% titanium, about 0.012% titanium, about 0.013% titanium, about 0.015% titanium, about 0.05% titanium, about 0.1% titanium, or about 0.15% titanium.

The alloys may comprise, by weight, 0% to about 0.15% vanadium, 0.05% to about 0.15% vanadium, 0% to about 0.1% vanadium, or about 0.05% to about 0.1% vanadium. The alloys may comprise, by weight, 0% to 0.15% vanadium, 0.05% to 0.15% vanadium, 0% to 0.1% vanadium, or 0.05% to 0.1% vanadium. The alloys may comprise, by weight, 0.001%, 0.005%, 0.01%, 0.02%, 0.03%, 0.04%, 0.05%, 0.06%, 0.07%, 0.08%, 0.09%, 0.1%, 0.11%, 0.12%, 0.13%, 0.14%, or 0.15% vanadium. The alloys may comprise, by weight, 0% titanium, about 0.005% vanadium, about 0.01% vanadium, about 0.05% vanadium, about 0.1% vanadium, or about 0.15% vanadium.

The alloys may comprise, by weight, a balance of iron and incidental elements and impurities. The term "incidental elements and impurities," may include one or more of phosphorous, silicon, manganese, aluminum, nitrogen, oxygen, and sulfur.

The incidental elements and impurities may include one or more of manganese (e.g., maximum 0.02%), silicon (e.g., maximum 0.04%), phosphorus (e.g., maximum 0.002%), sulfur (e.g., maximum 0.002%), aluminum (e.g., maximum 0.002%), nitrogen (e.g., maximum 0.002%), and oxygen (e.g., maximum 0.01%).

The alloys may comprise, by weight, 12.4% chromium, 1.4% nickel, 0.3% copper, 0.14% carbon, 0.05% niobium, 2.8% cobalt, 1.5% molybdenum, 0.006% titanium, and the balance of weight comprising iron and incidental elements and impurities. The incidental elements and impurities may include one or more of manganese (e.g., maximum 0.02%), silicon (e.g., maximum 0.04%), phosphorus (e.g., maximum 0.002%), sulfur (e.g., maximum 0.002%), aluminum (e.g., maximum 0.002%), nitrogen (e.g., maximum 0.002%), and oxygen (e.g., maximum 0.01%).

The alloys may comprise, by weight, 12.0% chromium, 1.7% nickel, 0.3% copper, 0.2% carbon, 0.04% niobium, 1.5% molybdenum, 0.01% titanium, and the balance of weight comprising iron and incidental elements and impurities. The incidental elements and impurities may include one or more of manganese (e.g., maximum 0.02%), silicon (e.g., maximum 0.04%), phosphorus (e.g., maximum 0.002%), sulfur (e.g., maximum 0.002%), aluminum (e.g., maximum 0.002%), nitrogen (e.g., maximum 0.002%), and oxygen (e.g., maximum 0.01%).

The alloys may comprise, by weight, 12.9% chromium, 1.3% nickel, 0.4% copper, 0.1% carbon, 0.05% niobium, 3.0% cobalt, 1.3% molybdenum, 0.008% titanium, and the balance of weight comprising iron and incidental elements and impurities. The incidental elements and impurities may include one or more of manganese (e.g., maximum 0.02%), silicon (e.g., maximum 0.04%), phosphorus (e.g., maximum 0.002%), sulfur (e.g., maximum 0.002%), aluminum (e.g., maximum 0.002%), nitrogen (e.g., maximum 0.002%), and oxygen (e.g., maximum 0.01%).

The alloys may comprise, by weight, 13.9% chromium, 1.2% nickel, 0.3% copper, 0.12% carbon, 0.05% niobium, 3.0% cobalt, 0.9% molybdenum, 0.02% titanium, and the balance of weight comprising iron and incidental elements and impurities. The incidental elements and impurities may include one or more of manganese (e.g., maximum 0.02%), silicon (e.g., maximum 0.04%), phosphorus (e.g., maximum 0.002%), sulfur (e.g., maximum 0.002%), aluminum (e.g., maximum 0.002%), nitrogen (e.g., maximum 0.002%), and oxygen (e.g., maximum 0.01%).

The alloys may comprise, by weight, 14.1% chromium, 0.4% nickel, 0.3% copper, 0.14% carbon, 0.04% niobium, 1.6% cobalt, 0.02% molybdenum, 0.01% titanium, and the balance of weight comprising iron and incidental elements and impurities. The incidental elements and impurities may include one or more of manganese (e.g., maximum 0.02%), silicon (e.g., maximum 0.04%), phosphorus (e.g., maximum 0.002%), sulfur (e.g., maximum 0.002%), aluminum (e.g., maximum 0.002%), nitrogen (e.g., maximum 0.002%), and oxygen (e.g., maximum 0.01%).

The alloys may consist of, by weight, 12.4% chromium, 1.4% nickel, 0.3% copper, 0.14% carbon, 0.05% niobium, 2.8% cobalt, 1.5% molybdenum, 0.006% titanium, and the balance of weight comprising iron and incidental elements and impurities. The incidental elements and impurities may include one or more of manganese (e.g., maximum 0.02%), silicon (e.g., maximum 0.04%), phosphorus (e.g., maximum 0.002%), sulfur (e.g., maximum 0.002%), aluminum (e.g., maximum 0.002%), nitrogen (e.g., maximum 0.002%), and oxygen (e.g., maximum 0.01%).

The alloys may consist of, by weight, 12.0% chromium, 1.7% nickel, 0.3% copper, 0.2% carbon, 0.04% niobium, 1.5% molybdenum, 0.01% titanium, and the balance of weight comprising iron and incidental elements and impurities. The incidental elements and impurities may include one or more of manganese (e.g., maximum 0.02%), silicon (e.g., maximum 0.04%), phosphorus (e.g., maximum 0.002%), sulfur (e.g., maximum 0.002%), aluminum (e.g., maximum 0.002%), nitrogen (e.g., maximum 0.002%), and oxygen (e.g., maximum 0.01%).

The alloys may consist of, by weight, 12.9% chromium, 1.3% nickel, 0.4% copper, 0.1% carbon, 0.05% niobium, 3.0% cobalt, 1.3% molybdenum, 0.008% titanium, and the balance of weight comprising iron and incidental elements and impurities. The incidental elements and impurities may include one or more of manganese (e.g., maximum 0.02%), silicon (e.g., maximum 0.04%), phosphorus (e.g., maximum 0.002%), sulfur (e.g., maximum 0.002%), aluminum (e.g., maximum 0.002%), nitrogen (e.g., maximum 0.002%), and oxygen (e.g., maximum 0.01%).

The alloys may consist of, by weight, 13.9% chromium, 1.2% nickel, 0.3% copper, 0.12% carbon, 0.05% niobium, 3.0% cobalt, 0.9% molybdenum, 0.02% titanium, and the balance of weight comprising iron and incidental elements and impurities. The incidental elements and impurities may include one or more of manganese (e.g., maximum 0.02%), silicon (e.g., maximum 0.04%), phosphorus (e.g., maximum 0.002%), sulfur (e.g., maximum 0.002%), aluminum (e.g., maximum 0.002%), nitrogen (e.g., maximum 0.002%), and oxygen (e.g., maximum 0.01%).

The alloys may consist of, by weight, 14.1% chromium, 0.4% nickel, 0.3% copper, 0.14% carbon, 0.04% niobium, 1.6% cobalt, 0.02% molybdenum, 0.01% titanium, and the balance of weight comprising iron and incidental elements and impurities. The incidental elements and impurities may include one or more of manganese (e.g., maximum 0.02%), silicon (e.g., maximum 0.04%), phosphorus (e.g., maximum 0.002%), sulfur (e.g., maximum 0.002%), aluminum (e.g., maximum 0.002%), nitrogen (e.g., maximum 0.002%), and oxygen (e.g., maximum 0.01%).

The alloys may have nitrogen solubility of about 0.25% to about 0.40% nitrogen, about 0.29% to about 0.40% nitrogen, about 0.3% to about 0.4% nitrogen, about 0.33% to about 0.4% nitrogen, about 0.36% to about 0.4% nitrogen, about 0.38% to about 0.4% nitrogen, about 0.29% to about 0.38% nitrogen, about 0.3% to about 0.38% nitrogen, about 0.33% to about 0.38% nitrogen, or about 0.36% to about 0.38% nitrogen. The alloys may comprise, by weight, 0.25% to 0.40% nitrogen, 0.29% to 0.40% nitrogen, 0.3% to 0.4% nitrogen, 0.33% to 0.4% nitrogen, 0.36% to 0.4% nitrogen, 0.38% to about 0.4% nitrogen, 0.29% to 0.38% nitrogen, 0.3% to 0.38% nitrogen, 0.33% to 0.38% nitrogen, or 0.36% to 0.38% nitrogen. The alloys may have nitrogen solubility of 0.25%, 0.26%, 0.27%, 0.28%, 0.29%, 0.3%, 0.31%, 0.32%, 0.33%, 0.34%, 0.35%, 0.36%, 0.37%, 0.38%, 0.39%, or 0.40% nitrogen. The alloys may have nitrogen solubility of about 0.25% nitrogen, about 0.29% nitrogen, about 0.3% nitrogen, about 0.33% nitrogen, about 0.36% nitrogen, about 0.38% nitrogen, or about 0.4% nitrogen.

The alloys may have a ratio of nitrogen to carbon, by weight, of 1.5 to 3.5, 1.65 to 3.5, 2.1 to 3.5, 2.5 to 3.5, 3 to 3.5, 1.5 to 3, 1.65 to 3, 2.1 to 3, or 2.5 to 3. The alloys may have a ratio of nitrogen to carbon, by weight, of about 1.5 to about 3.5, about 1.65 to about 3.5, about 2.1 to about 3.5, about 2.5 to about 3.5, about 3 to about 3.5, about 1.5 to about 3, about 1.65 to about 3, about 2.1 to about 3, or about 2.5 to about 3. The alloys may have a ratio of nitrogen to carbon, by weight, of 1.5, 1.55. 1.6, 1.65, 1.7, 1.75, 1.8, 1.85, 1.9, 1.95, 2, 2.1, 2.15, 2.2, 2.25, 2.3, 2.35, 2.4, 2.45, 2.5, 2.55, 2.6, 2.65, 2.7, 2.75, 2.8, 2.85, 2.9, 3, 3.1, 3.15, 3.2, 3.25, 3.3, 3.35, 3.4, 3.45, or 3.5. The alloys may have a ratio of nitrogen to carbon, by weight, of about 1.5, about 1.65, about 2.1, about 2.5, about 3.0, or about 3.5.

The alloys may have a sum of nitrogen and carbon content, by weight, of about 0.35% to about 0.65%, about 0.4% to about 0.65%, about 0.43% to about 0.65%, about 0.48% to about 0.65%, about 0.53% to about 0.65%, about 0.4% to about 0.53%, about 0.43% to about 0.53%, or about 0.48% to about 0.53%. The alloys may have a sum of nitrogen and carbon content, by weight, of 0.35% to 0.65%, 0.4% to 0.65%, 0.43% to 0.65%, 0.48% to 0.65%, 0.53% to 0.65%, 0.4% to 0.53%, 0.43% to 0.53%, or 0.48% to 0.53%. The alloys may have a sum of nitrogen and carbon content, by weight, of 0.35%, 0.36%, 0.37%, 0.38%, 0.39%, 0.4%, 0.41%, 0.42%, 0.43%, 0.44%, 0.45%, 0.46%, 0.47%, 0.48%, 0.49%, 0.5%, 0.51%, 0.52%, 0.53%, 0.54%, 0.55%, 0.56%, 0.57%, 0.58%, 0.59%, 0.6%, 0.61%, 0.62%, 0.63%, 0.64%, or 0.65%. The alloys may have a sum of nitrogen and carbon content, by weight, of about 0.35%, about 0.4%, about 0.43%, about 0.48%, about 0.53%, about 0.6%, or about 0.65%.

The alloys may have a core δ-ferrite solvus temperature of 1000° C. to 1300° C., 1050° C. to 1300° C., 1100° C. to 1300° C., 1150° C. to 1300° C., 1180° C. to 1300° C., 1190° C. to 1300° C., 1220° C. to 1300° C., 1225° C. to 1300° C., 1180° C. to 1225° C., 1190° C. to 1225° C., or 1200° C. to 1225° C. The alloys may have a core δ-ferrite solvus temperature of at least 1000° C., at least 1050° C., at least 1100° C., at least 1150° C., at least 1180° C., at least 1190° C., at least 1200° C., at least 1220° C., at least 1225° C., at least 1250° C., at least 1270° C., or at least 1300° C. The alloys may have a core δ-ferrite solvus temperature of about 1150° C., about 1180° C., about 1190° C., about 1200° C., or about 1225° C.

The alloys may have a case martensite start temperature of 140° C. to 300° C., 145° C. to 300° C., 150° C. to 300° C., 177° C. to 300° C., 180° C. to 300° C., 198° C. to 300° C., 200° C. to 300° C., 203° C. to 300° C., 145° C. to 203° C., 177° C. to 203° C., 180° C. to 203° C., or 198° C. to 203° C. The alloys may have a case martensite start temperature of at least 140° C., at least 145° C., at least 150° C., at least 177° C., at least 180° C., at least 198° C., at least 200° C., at least 203° C., at least 225° C., at least 250° C., at least 275° C., or at least 300° C. The alloys may have a case martensite start temperature of about 145° C., about 177° C., about 180° C. about 198° C., or about 203° C.

The alloys may have a case hardness of 55 HRC to 65 HRC. The alloys may have a case hardness of at least 55 HRC, at least 56 HRC, at least 57 HRC, at least 58 HRC, at least 59 HRC, at least 60 HRC, at least 61 HRC, at least 62 HRC, at least 63 HRC, at least 64 HRC, or at least 65 HRC. The alloys may have a case hardness of 55 HRC, 56 HRC, 57 HRC, 58 HRC, 59 HRC, 60 HRC, 61 HRC, 62 HRC, 63 HRC, 64 HRC, or 65 HRC. The alloys may have a case hardness of about 55 HRC, about 56 HRC, about 57 HRC, about 58 HRC, about 59 HRC, about 60 HRC, about 61 HRC, about 62 HRC, about 63 HRC, about 64 HRC, or about 65 HRC. The case hardness may be measured according to the micro-Vickers method in accordance with ASTM E384 standards, and converted to Rockwell C scale in accordance with ASTM E140 conversion standards.

The alloys may have a case hardness of 45 HRC to 60 HRC, 50 HRC to 60 HRC, 53 HRC to 60 HRC, 53 HRC to 55 HRC, or 55 HRC to 60 HRC at a depth of 0.02 inches. The alloys may have a case hardness of at least 45 HRC, at least 46 HRC, at least 47 HRC, at least 48 HRC, at least 49 HRC, at least 50 HRC, at least 51 HRC, at least 52 HRC, at least 53 HRC, at least 54 HRC, at least 55 HRC, at least 56 HRC, at least 57 HRC, at least 58 HRC, at least 59 HRC, or at least 60 HRC at a depth of 0.02 inches. The alloys may have a case hardness of 45 HRC, 46 HRC, 47 HRC, 48 HRC, 49 HRC, 50 HRC, 51 HRC, 52 HRC, 53 HRC, 54 HRC, 55 HRC, 56 HRC, 57 HRC, 58 HRC, 59 HRC, or 60 HRC at a depth of 0.02 inches. The alloys may have a case hardness of about 50 HRC, about 53 HRC, or about 55 HRC at a depth of 0.02 inches. The case hardness may be measured according to the micro-Vickers method in accordance with ASTM E384 standards, and converted to Rockwell C scale in accordance with ASTM E140 conversion standards.

The alloys may have a tensile strength of 180 ksi to 250 ksi, 190 ksi to 250 ksi, 200 ksi to 250 ksi, 206 ksi to 250 ksi, 210 ksi to 250 ksi, 220 ksi to 250 ksi, 223 ksi to 250 ksi, 230 ksi to 250 ksi, 240 ksi to 250 ksi, 200 ksi to 230 ksi, or 206 ksi to 223 ksi. The alloys may have a tensile strength of at least 180 ksi, at least 190 ksi, at least 200 ksi, at least 206 ksi, at least 210 ksi, at least 220 ksi, at least 223 ksi, at least 230 ksi, at least 240 ksi, or at least 250 ksi. The alloys may have a tensile strength of 180 ksi, 185 ksi, 190 ksi, 191 ksi, 192 ksi, 193 ksi, 194 ksi, 195 ksi, 196 ksi, 197 ksi, 198 ksi, 199 ksi, 200 ksi, 201 ksi, 202 ksi, 203 ksi, 204 ksi, 205 ksi, 206 ksi, 207 ksi, 208 ksi, 209 ksi, 210 ksi, 211 ksi, 212 ksi, 213 ksi, 214 ksi, 215 ksi, 216 ksi, 217 ksi, 218 ksi, 219 ksi, 220 ksi, 221 ksi, 222 ksi, 223 ksi, 224 ksi, 225 ksi, 226 ksi, 227 ksi, 228 ksi, 229 ksi, 230 ksi, 235 ksi, 240 ksi, 245 ksi, or 250 ksi. The alloys may have a tensile strength of about 180 ksi, about 200 ksi, about 206 ksi, about 220 ksi, or about 223 ksi. The tensile strength may be measured according to ASTM E8.

The alloys may have a 0.2% offset yield strength, of 150 ksi to 200 ksi, 160 ksi to 200 ksi, 163 ksi to 200 ksi, 170 ksi to 200 ksi, 172 ksi to 200 ksi, 150 ksi to 180 ksi, 160 ksi to 180 ksi, 163 ksi to 180 ksi, or 163 ksi to 172 ksi. The alloys may have 0.2% offset yield strength of at least 190 ksi, or at least 200 ksi. The alloys may have a 0.2% offset yield strength of 150 ksi, 155 ksi, 156 ksi, 157 ksi, 158 ksi, 159 ksi, 160 ksi, 161 ksi, 162 ksi, 163 ksi, 164 ksi, 165 ksi, 166 ksi, 167 ksi, 168 ksi, 169 ksi, 170 ksi, 171 ksi, 172 ksi, 173 ksi, 174 ksi, 175 ksi, 176 ksi, 177 ksi, 178 ksi, 179 ksi, 180 ksi, 181 ksi, 182 ksi, 183 ksi, 184 ksi, 185 ksi, 190 ksi, 195 ksi, or 200 ksi. The alloys may have a tensile strength of about 150 ksi, about 160 ksi, about 163 ksi, about 170 ksi, about 172 ksi, about 180 ksi, or about 200 ksi. The 0.2% offset yield strength may be measured according to ASTM E8.

The alloys may have a percent elongation of 1% to 50%, 10% to 40%, or 20% to 30%. The alloys may have an elongation of at least 5%, at least 10%, at least 15%, at least 18%, at least 20%, at least 22%, at least 23%, at least 25%, at least 30%, at least 35%, at least 40%, at least 45%, or at least 50%. The alloys may have an elongation of 5%, 10%, 15%, 16%, 17%, 18%, 19%, 20%, 21%, 22%, 23%, 24%, 25%, 26%, 27%, 28%, 29%, 30%, 31%, 32%, 33%, 34%, 35%, 36%, 37%, 38%, 39%, 40%, 45%, or 50%. The alloys may have an elongation of about 5%, about 10%, about 15%, about 19%, about 20%, about 22%, about 23%, about 25%, about 30%, about 35%, about 40%, about 45%, or about 50%. The elongation may be measured according to ASTM E8.

The alloys may have a tensile reduction in area, of 50% to 90%, 60% to 90%, 70% to 80%, 70% to 75%, 71% to 75%, or 71% to 73%. The alloys may have a tensile reduction in area, of at least 50%, at least 55%, at least 60%, at least 65%, at least 70%, at least 71%, at least 73%, at least 75%, at least 80%, at least 85%, or at least 90%. The alloys may have a tensile reduction in area, of 50%, 51%, 52%, 53%, 54%, 55%, 56%, 57%, 58%, 59%, 60%, 61%, 62%, 63%, 64%, 65%, 66%, 67%, 68%, 69%, 70%, 71%, 72%, 73%, 74%, 75%, 76%, 77%, 78%, 79%, 80%, 81%, 82%, 83%, 84%, 85%, 86%, 87%, 88%, 89%, or 90%. The alloys may have a tensile reduction in area, of about 50%, about 55%, about 60%, about 65%, about 70%, about 71%, about 73%, about 75%, about 80%, about 85%, or about 90%. The tensile reduction in area may be measured according to ASTM E8.

The alloys may have a fracture toughness of 30 ksi*in$^{1/2}$ to 120 ksi*in$^{1/2}$, 40 ksi*in$^{1/2}$ to 120 ksi*in$^{1/2}$, 50 ksi*in$^{1/2}$ to 120 ksi*in$^{1/2}$, 52 ksi*in$^{1/2}$ to 115 ksi*in$^{1/2}$, 60 ksi*in$^{1/2}$ to 80 ksi*in$^{1/2}$, 70 ksi*in$^{1/2}$ to 80 ksi*in$^{1/2}$, 40 ksi*in$^{1/2}$ to 70 ksi*in$^{1/2}$, or 50 ksi*in$^{1/2}$ to 60 ksi*in$^{1/2}$. The alloys may have a fracture toughness of at least 30 ksi*in$^{1/2}$, at least 40 ksi*in$^{1/2}$, at least 50 ksi*in$^{1/2}$, at least 60 ksi*in$^{1/2}$, at least 70 ksi*in$^{1/2}$, at least 80 ksi*in$^{1/2}$, at least 90 ksi*in$^{1/2}$, at least 100 ksi*in$^{1/2}$, or at least 110 ksi*in$^{1/2}$. The alloys may have a fracture toughness of 30 ksi*in$^{1/2}$, 35 ksi*in$^{1/2}$, 40 ksi*in$^{1/2}$, 41 ksi*in$^{1/2}$, 42 ksi*in$^{1/2}$, 43 ksi*in$^{1/2}$, 44 ksi*in$^{1/2}$, 45 ksi*in$^{1/2}$, 46 ksi*in$^{1/2}$, 47 ksi*in$^{1/2}$, 48 ksi*in$^{1/2}$, 49 ksi*in$^{1/2}$, 50 ksi*in$^{1/2}$, 51 ksi*in$^{1/2}$, 52 ksi*in$^{1/2}$, 53 ksi*in$^{1/2}$, 54 ksi*in$^{1/2}$, 55 ksi*in$^{1/2}$, 56 ksi*in$^{1/2}$, 57 ksi*in$^{1/2}$, 58 ksi*in$^{1/2}$, 59 ksi*in$^{1/2}$, 60 ksi*in$^{1/2}$, 61 ksi*in$^{1/2}$, 62 ksi*in$^{1/2}$, 63 ksi*in$^{1/2}$, 64 ksi*in$^{1/2}$, 65 ksi*in$^{1/2}$, 66 ksi*in$^{1/2}$, 67 ksi*in$^{1/2}$, 68 ksi*in$^{1/2}$, 69 ksi*in$^{1/2}$, 70 ksi*in$^{1/2}$, 71 ksi*in$^{1/2}$, 72 ksi*in$^{1/2}$, 73 ksi*in$^{1/2}$, 74 ksi*in$^{1/2}$, 75 ksi*in$^{1/2}$, 76 ksi*in$^{1/2}$, 77 ksi*in$^{1/2}$, 78 ksi*in$^{1/2}$, 79 ksi*in$^{1/2}$, 80 ksi*in$^{1/2}$, 81 ksi*in$^{1/2}$, 82 ksi*in$^{1/2}$, 83 ksi*in$^{1/2}$, 84 ksi*in$^{1/2}$, 85 ksi*in$^{1/2}$, 86 ksi*in$^{1/2}$, 87 ksi*in$^{1/2}$, 88 ksi*in$^{1/2}$, 89 ksi*in$^{1/2}$, 90 ksi*in$^{1/2}$, 91 ksi*in$^{1/2}$, 92 ksi*in$^{1/2}$, 93 ksi*in$^{1/2}$, 94 ksi*in$^{1/2}$, 95 ksi*in$^{1/2}$, 96 ksi*in$^{1/2}$, 97 ksi*in$^{1/2}$, 98 ksi*in$^{1/2}$, 99 ksi*in$^{1/2}$, 100 ksi*in$^{1/2}$, 101 ksi*in$^{1/2}$, 102 ksi*in$^{1/2}$, 103 ksi*in$^{1/2}$, 104 ksi*in$^{1/2}$, 105 ksi*in$^{1/2}$, 106 ksi*in$^{1/2}$, 107 ksi*in$^{1/2}$, 108 ksi*in$^{1/2}$, 1099 ksi*in$^{1/2}$, 110 ksi*in$^{1/2}$, 111 ksi*in$^{1/2}$, 112 ksi*in$^{1/2}$, 113 ksi*in$^{1/2}$, 114 ksi*in$^{1/2}$, 115 ksi*in$^{1/2}$, 116 ksi*in$^{1/2}$, 117 ksi*in$^{1/2}$, 118 ksi*in$^{1/2}$, 119 ksi*in$^{1/2}$, or 120 ksi*in$^{1/2}$. The alloys may have a fracture toughness of about 30 ksi*in$^{1/2}$, about 40 ksi*in$^{1/2}$, about 50 ksi*in$^{1/2}$ to 80 ksi*in$^{1/2}$, about 52 ksi*in$^{1/2}$ about 60 ksi*in$^{1/2}$, about 70 ksi*in$^{1/2}$, about 79 ksi*in$^{1/2}$, about 92 ksi*in$^{1/2}$, or about 111 ksi*in$^{1/2}$. The fracture toughness may be measured according to ASTM E399. The units "ksi*in$^{1/2}$" may also be expressed as ksi$\sqrt{\text{in}}$.

The alloys may have a grain pinning dispersion of MC particles, or a combination thereof. The MC particles may include niobium or titanium. For example, M, at each occurrence, may be independently selected from the group consisting of niobium and titanium. Exemplary grain pinning particles include, but are not limited to, NbC, $Nb_2C$, TiC, and $Ti_2C$. The alloys may have a grain pinning dispersion comprising any of the aforementioned particles, or any combination thereof.

The alloys may have an average grain width of 10 microns to 100 microns, 20 microns to 100 microns, 30 microns to 100 microns, 40 microns to 100 microns, 50 microns to 100 microns, 60 microns to 100 microns, 70 microns to 100 microns, 80 microns to 100 microns, 20 microns to 80 microns, 20 microns to 30 microns, 25 microns to 50 microns, 20 microns to 60 microns, 25 microns to 60 microns, 25 microns to 80 microns, 50 microns to 80 microns, 60 microns to 80 microns, 70 microns to 80 microns, 50 microns to 60 microns, or 80 microns to 90 microns. The alloys may have an average grain width of about 10 microns to about 100 microns, about 20 microns to about 100 microns, about 30 microns to about 100 microns, about 40 microns to about 100 microns, about 50 microns to about 100 microns, about 60 microns to about 100 microns, about 70 microns to about 100 microns, about 80 microns to about 100 microns, about 20 microns to about 80 microns, about 20 microns to about 30 microns, about 25 microns to about 50 microns, about 20 microns to about 60 microns, about 25 microns to about 60 microns, about 25 microns to about 80 microns, about 50 microns to about 80 microns, about 60 microns to about 80 microns, about 70 microns to about 80 microns, about 50 microns to about 60 microns, or about 80 microns to about 90 microns. The alloys may have an average grain width of 10 microns, 11 microns, 12 microns, 13 microns, 14 microns, 15 microns, 16 microns, 17 microns, 18 microns, 19 microns, 20 microns, 21 microns, 22 microns, 23 microns, 24 microns, 25 microns, 26 microns, 27 microns, 28 microns, 29 microns, 30 microns, 31 microns, 32 microns, 33 microns, 34 microns, 35 microns, 36 microns, 37 microns, 38 microns, 39 microns, 40 microns, 41 microns, 42 microns, 43 microns, 44 microns, 45 microns, 46 microns, 47 microns, 48 microns, 49 microns, 50 microns, 51 microns, 52 microns, 53 microns, 54 microns, 55 microns, 56 microns, 57 microns, 58 microns, 59 microns, 60 microns, 61 microns, 62 microns, 63 microns, 64 microns, 65 microns, 66 microns, 67 microns, 68 microns, 69 microns, 70 microns, 71 microns, 72 microns, 73 microns, 74 microns, 75 microns, 76 microns, 77 microns, 78 microns, 79 microns, 80 microns, 81 microns, 82 microns, 83 microns, 84 microns, 85 microns, 86 microns, 87 microns, 88 microns, 89 microns, 90 microns, 91 microns, 92 microns, 93 microns, 94 microns, 95 microns, 96 microns, 97 microns, 98 microns, 99 microns, or 100 microns. The alloys may have an average grain width of about 10 microns, about 20 microns, about 25 microns, about 30 microns, about 40 microns, about 50 microns, about 60 microns, about 70 microns, about 80 microns, about 90 microns, or about 100 microns. The average grain width of the alloy may be measured according to ASTM E112 standards.

III. METHODS OF MAKING ALLOYS

The alloys may be produced by Vacuum Induction melting (VIM) followed by Vacuum Arc Remelting (VAR). The alloys may be produced as 30 pound, 4 inch diameter by 10 inch long cylindrical ingots. Ingots may be homogenized at 1100° C. for 24 hours followed by further homogenization at 1150° C. for 24 hours. The ingots may then be hot rolled at 1150° C. into 0.75 inch thick plates. The hot rolled plates may be normalized at 1000° C. for 1 hour, followed by treatment with cooling air. The plates may be annealed at 625° C. for 8 hours followed by cooling to room temperature in air.

The alloys may be subjected to solution nitriding. Solution nitriding may be completed using conventional commercial-scale vacuum furnaces. The alloys may be vacuum heat treated at 1100° C. for 4 hours in the presence of 100% $N_2$ gas, at a partial pressure of 1 PSIG. The alloys may then be quenched in $N_2$ gas (pressure of 6 Bar) and cooled to room temperature.

The alloys may be subjected to an isothermal aging treatment at temperatures in the range of 420° C. to 496° C. for up to 32 hours, resulting in simultaneous precipitation of copper-nucleated nitride particles in the case layer and copper-nucleated carbide particles in the core material.

IV. ARTICLES OF MANUFACTURE

Also disclosed are manufactured articles including the disclosed alloys. Exemplary manufactured articles include, but are not limited to, aircraft engine bearings and lift fan gearbox bearings.

V. EXAMPLES

Stainless steel alloys were prepared and tested for physical properties. Table 1 shows the composition of the exemplified alloys (Alloys A-E). Table 2 shows the incidental elements and impurities present in the exemplified alloys

TABLE 1

Composition weight percentages of Alloys A-E

| Alloy | C | Cr | Ni | Mo | Co | Cu | Nb | Ti | Fe |
|---|---|---|---|---|---|---|---|---|---|
| A | 0.14% | 12.4% | 1.4% | 1.5% | 2.8% | 0.3% | 0.05% | 0.006% | balance |
| B | 0.2% | 12.0% | 1.7% | 1.5% | — | 0.3% | 0.04% | 0.013% | balance |
| C | 0.1% | 12.9% | 1.3% | 1.3% | 3.0% | 0.4% | 0.05% | 0.008% | balance |

TABLE 1-continued

| Composition weight percentages of Alloys A-E | | | | | | | | | |
|---|---|---|---|---|---|---|---|---|---|
| Alloy | C | Cr | Ni | Mo | Co | Cu | Nb | Ti | Fe |
| D | 0.12% | 13.9% | 1.2% | 0.9% | 3.0% | 0.3% | 0.05% | 0.015% | balance |
| E | 0.14% | 14.1% | 0.36% | 0.02% | 1.6% | 0.3% | 0.04% | 0.012% | balance |

TABLE 2

| Weight percentages of the incidental elements and impurities of Alloys A-E | | | | | | | |
|---|---|---|---|---|---|---|---|
| Alloy | Mn (%) | Si (%) | Al (%) | P (ppm) | S (ppm) | N (ppm) | O (ppm) |
| A | — | 0.009 | — | 5 | 8 | 23 | 29 |
| B | — | 0.011 | — | 5 | 9 | 14 | 29 |
| C | 0.01 | 0.04 | 0.002 | 10 | 13 | 10 | 90 |
| D | 0.01 | 0.007 | 0.002 | 10 | 15 | 10 | 100 |
| E | 0.02 | 0.01 | 0.001 | 10 | 16 | 10 | 90 |

Example 1: Alloy A

A melt was prepared with the nominal composition of 0.14 C, 12.4 Cr, 1.4 Ni, 1.5 Mo, 2.8 Co, 0.3 Cu, 0.05 Nb, 0.006 Ti, and balance Fe, in wt %. The melt was produced by double vacuum melting: Vacuum Induction melting (VIM) followed by Vacuum Arc Remelting (VAR). The melts were shaped as 30 pound, 4 inch diameter by 10 inch long cylindrical ingots. Ingots were step homogenized at 1100° C. for 24 hours followed by 1150° C. for 24 hours, then hot rolled at 1150° C. into 0.75 inch thick plates. The hot rolled plates were normalized at 1000° C. for 1 hour, followed by treatment with cooling air. The plates were annealed at 625° C. for 8 hours followed by cooling to room temperature in air.

Solution nitriding was completed at Solar Atmospheres (Souderton, Pa.) using conventional commercial-scale vacuum furnaces. Test pieces were vacuum heat treated at 1100° C. for 4 hours in the presence of 100% $N_2$ gas at a partial pressure of 1 PSIG, followed by gas quenching in 6 Bar $N_2$ gas to room temperature.

Samples were subjected to an isothermal aging treatment at temperatures in the range of 420° C. to 496° C. for up to 32 hours, resulting in simultaneous precipitation of copper-nucleated nitride particles in the case layer and copper-nucleated carbide particles in the core material.

Alloy A was determined to possess nitrogen solubility of 0.29% and a ratio of nitrogen to carbon of 2.1.

Example 2: Alloy B

A melt was prepared with the nominal composition of 0.2 C, 12.0 Cr, 1.7 Ni, 1.5 Mo, 0.3 Cu, 0.04 Nb, 0.01 Ti and balance Fe, in wt %. The melt was produced by double vacuum melting: Vacuum Induction melting (VIM) followed by Vacuum Arc Remelting (VAR). The melts were shaped as 30 pound, 4 inch diameter by 10 inch long cylindrical ingots. Ingots were step homogenized at 1100° C. for 24 hours followed by 1150° C. for 24 hours, then hot rolled at 1150° C. into 0.75 inch thick plates. The hot rolled plates were normalized at 1000° C. for 1 hour, followed by treatment with cooling air. The plates were annealed at 625° C. for 8 hours followed by cooling to room temperature in air.

Solution nitriding was completed at Solar Atmospheres (Souderton, Pa.) using conventional commercial-scale vacuum furnaces. Test pieces were vacuum heat treated at 1100° C. for 4 hours in the presence of 100% $N_2$ gas at a partial pressure of 1 PSIG, followed by gas quenching in 6 Bar $N_2$ gas to room temperature.

Samples were subjected to an isothermal aging treatment at temperatures in the range of 420° C. to 496° C. for up to 32 hours, resulting in simultaneous precipitation of copper-nucleated nitride particles in the case layer and copper-nucleated carbide particles in the core material.

Alloy B was determined to possess nitrogen solubility of 0.33% and a ratio of nitrogen to carbon of 1.65.

Example 3: Alloy C

A melt was prepared with the nominal composition of 0.1 C, 12.9 Cr, 1.3 Ni, 1.3 Mo, 3.0 Co, 0.4 Cu, 0.05 Nb, 0.008 Ti, and balance Fe, in wt %. The melt was produced by double vacuum melting: Vacuum Induction melting (VIM) followed by Vacuum Arc Remelting (VAR). The melts were shaped as 30 pound, 4 inch diameter by 10 inch long cylindrical ingots. Ingots were step homogenized at 1100° C. for 24 hours followed by 1150° C. for 24 hours, then hot rolled at 1150° C. into 0.75 inch thick plates. The hot rolled plates were normalized at 1000° C. for 1 hour, followed by treatment with cooling air. The plates were annealed at 625° C. for 8 hours followed by cooling to room temperature in air.

Solution nitriding was completed at Solar Atmospheres (Souderton, Pa.) using conventional commercial-scale vacuum furnaces. Test pieces were vacuum heat treated at 1100° C. for 4 hours in the presence of 100% $N_2$ gas at a partial pressure of 1 PSIG, followed by gas quenching in 6 Bar $N_2$ gas to room temperature.

Samples were subjected to an isothermal aging treatment at temperatures in the range of 420° C. to 496° C. for up to 32 hours, resulting in simultaneous precipitation of copper-nucleated nitride particles in the case layer and copper-nucleated carbide particles in the core material.

Alloy C was determined to possess nitrogen solubility of 0.3% and a ratio of nitrogen to carbon of 3.0.

Example 4: Alloy D

A melt was prepared with the nominal composition of 0.12 C, 13.9 Cr, 1.2 Ni, 0.9 Mo, 3.0 Co, 0.3 Cu, 0.05 Nb, 0.02 Ti, and balance Fe, in wt %. The melt was produced by double vacuum melting: Vacuum Induction melting (VIM) followed by Vacuum Arc Remelting (VAR). The melts were shaped as 30 pound, 4 inch diameter by 10 inch long cylindrical ingots. Ingots were step homogenized at 1100° C. for 24 hours followed by 1150° C. for 24 hours, then hot rolled at 1150° C. into 0.75 inch thick plates. The hot rolled plates were normalized at 1000° C. for 1 hour, followed by treatment with cooling air. The plates were annealed at 625° C. for 8 hours followed by cooling to room temperature in air.

Solution nitriding was completed at Solar Atmospheres (Souderton, Pa.) using conventional commercial-scale vacuum furnaces. Test pieces were vacuum heat treated at 1100° C. for 4 hours in the presence of 100% $N_2$ gas at a partial pressure of 1 PSIG, followed by gas quenching in 6 Bar $N_2$ gas to room temperature.

Samples were subjected to an isothermal aging treatment at temperatures in the range of 420° C. to 496° C. for up to 32 hours, resulting in simultaneous precipitation of copper-nucleated nitride particles in the case layer and copper-nucleated carbide particles in the core material.

Alloy D was determined to possess nitrogen solubility of 0.36% and a ratio of nitrogen to carbon of 3.0.

Example 5: Alloy E

A melt was prepared with the nominal composition of 0.14 C, 14.1 Cr, 0.4 Ni, 1.6 Co, 0.3 Cu, 0.04 Nb, 0.01 Ti, and balance Fe, in wt %. The melt was produced by double vacuum melting: Vacuum Induction melting (VIM) followed by Vacuum Arc Remelting (VAR). The melts were shaped as 30 pound, 4 inch diameter by 10 inch long cylindrical ingots. Ingots were step homogenized at 1100° C. for 24 hours followed by 1150° C. for 24 hours, then hot rolled at 1150° C. into 0.75 inch thick plates. The hot rolled plates were normalized at 1000° C. for 1 hour, followed by treatment with cooling air. The plates were annealed at 625° C. for 8 hours followed by cooling to room temperature in air.

Solution nitriding was completed at Solar Atmospheres (Souderton, Pa.) using conventional commercial-scale vacuum furnaces. Test pieces were vacuum heat treated at 1100° C. for 4 hours in the presence of 100% $N_2$ gas at a partial pressure of 1 PSIG, followed by gas quenching in 6 Bar $N_2$ gas to room temperature.

Samples were subjected to an isothermal aging treatment at temperatures in the range of 420° C. to 496° C. for up to 32 hours, resulting in simultaneous precipitation of copper-nucleated nitride particles in the case layer and copper-nucleated carbide particles in the core material.

Alloy E was determined to possess nitrogen solubility of 0.36% and a ratio of nitrogen to carbon of 2.5.

A. Physical Testing of Alloys

Test alloys were prepared as specified above. Test specimens were characterized for solution nitridability, core mechanical properties, and corrosion resistance.

Measurements of grain size were made as the mean linear intercept length in the short-transverse direction of the rolled plate material. Grains were heavily elongated in the rolling direction, and flattened in the short-transverse direction, so this measurement represents the minor dimension of the grains. Measurements were made in accordance with ASTM E112 standards. Alloy A was determined to have an average grain width of 25 microns (ASTM grain size 7), while Alloy B was determined to have an average grain width of 80 microns (ASTM grain size 4).

Figure 2:
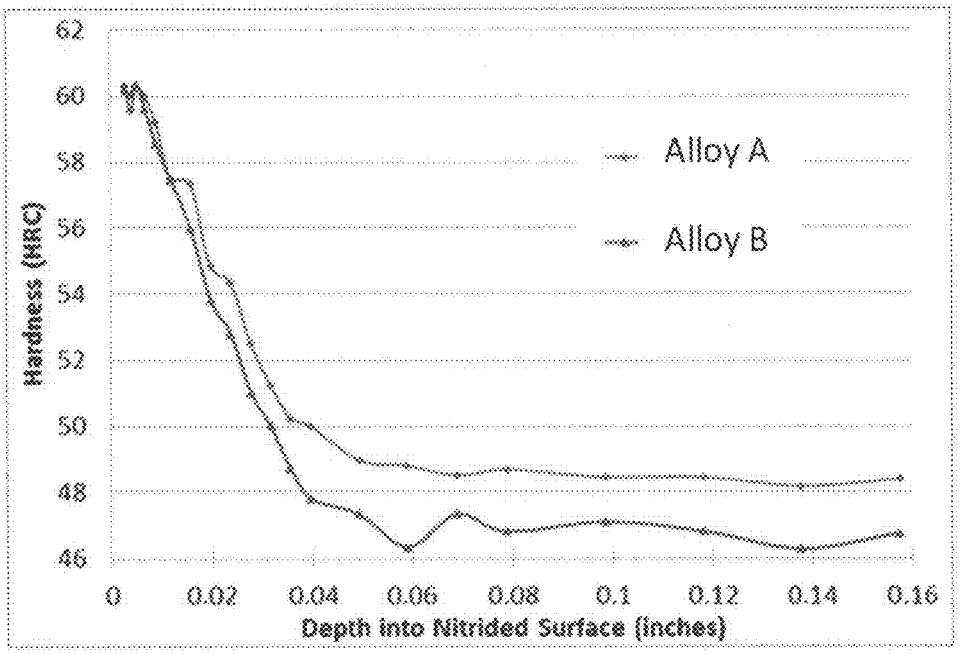
FIG. 2 is a graph depicting the case hardness of alloys A and B at a series of depths into the surface of the alloy.

The hardness profiles of alloys A and B were determined as illustrated in FIG. 2. Nitrogen solubility is a fixed design parameter that is a function of the base composition only. The variance in hardness with depth is due to the solution nitriding process; nitrogen diffuses into the steel at high temperature which results in a gradient in nitrogen content into the surface. The nitrogen solubility defines the maximum achievable nitrogen content at the surface, which in turn defines the maximum achievable surface hardness. These alloys demonstrate excellent hardness values of up to 60 HRC at the surface of the alloys, while hardness values remain high (>50 HRC) at depths of up to 0.04 inches. Measurements of case hardness were made using the micro-Vickers method in accordance with ASTM E384 standards, and converted to Rockwell C scale in accordance with ASTM E140 conversion standards.

Core mechanical properties were determined for alloys A-E. Table 3 reveals these alloys had high strength, as measured by the ultimate tensile strength, 0.2% offset yield strength and fracture toughness. In addition, the ductility properties of alloys A-E were excellent. Tensile strength and ductility was determined according to ASTM E8 standards, while fracture toughness was determined according to ASTM E399 standards.

Case martensite start temperatures were determined for alloys A-E, as shown in Table 3. Case martensite start temperatures were calculated using QuesTek's internally developed computational modeling capabilities, using commercially available ThermoCalc software and associated thermodynamic databases. The case martensite start temperature was improved in the alloys possessing titanium (C-E). These results also suggest that cobalt contributes to a higher case martensite start temperature as well.

Also shown in Table 3, the δ-ferrite solvus temperatures were high for all alloys, indicating good stability of the austenite phase. These high δ-ferrite solvus temperatures help to ensure sufficient processing windows for the alloys. Delta ferrite solvus temperatures were calculated using QuesTek's internally developed computational modeling capabilities, using commercially available ThermoCalc software and associated thermodynamic databases.

TABLE 3

| Alloy | Ultimate Tensile Strength (ksi) | Tensile Yield Strength (ksi) | % Elongation | % RA | Fracture toughness (ksi$\sqrt{in}$) | Case martensite start temp (° C.) | δ-ferrite solvus temp (° C.) |
|---|---|---|---|---|---|---|---|
| A | 223 | 172 | 23 | 71 | 60 | 177 | 1225 |
| B | 206 | 163 | 22 | 73 | 52 | 145 | 1200 |
| C | 190 | 151 | 20 | 64 | 92 | 198 | 1190 |
| D | 198 | 156 | 20 | 71 | 79 | 180 | 1180 |
| E | 202 | 155 | 19 | 59 | 111 | 203 | 1180 |

% RA = percent tensile reduction in area

The compositions of the disclosed embodiments result in a combination of carbon and nitrogen in wt % in the range of about 4-5.5 to 6 in the case of a casting. The variant alloys thus efficiently enable manufacture of a case hardened component with lower cobalt and nickel content thereby enhancing the opportunity for transformation into a martensitic phase at a reasonable transformation temperature while simultaneously increasing the carbon content to maintain core mechanical properties. The chromium content is increased or maintained for corrosion resistance. The inclusion of a lower cobalt content in combination with copper nucleated nitride particles results in both surface hardening and superior core mechanical properties. Secondary hardening during tempering is achieved by the simultaneous precipitation of copper-nucleated nitride particles in the nitride case and copper-nucleated carbide particles in the core to provide the combination of surface and core properties. Processability opportunities are also enhanced inasmuch as the alloy may be worked and subsequently case hardened.

Thus, the alloys are designed to be case hardenable. The alloys described and processed in U.S. patent application Ser. No. 12/937,348 were deliberately alloyed with nitrogen during the melting process to yield a specific carbon+ nitrogen (C+N) content to achieve a microstructure (copper-nucleated $M_2N$ precipitation within a martensitic stainless steel) that yields specific novel properties. The alloys described herein utilized a similar microstructural approach or concept (copper-nucleated $M_2N$ precipitation within a martensitic stainless steel including the feature of matrix) to achieve high surface hardness in a case-hardenable alloy, but with no deliberate nitrogen during melting. Modifications to the alloy design to achieve this include the following: 1) equivalent C+N alloying content is maintained during melting, but C is favored for conventional melt processing and core mechanical properties; 2) high nitrogen contents necessary for case hardness are incorporated using a secondary processing step of "Solution Nitriding" (solution nitriding results in ~0.3 wt % N in the case, maintaining a N/C ratio consistent with the alloys of U.S. patent application Ser. No. 12/937,348); 3) high surface hardness is achieved through copper-nucleated $M_2N$ precipitation in the case during tempering; and 4) high nitrogen content in the case lowers the martensite transformation temperature, and nickel content is lowered to raise the Ms temperature of the case an acceptable level to avoid retained austenite phase (austenite being detrimental to surface hardness and $M_2N$ precipitation.

Figure 5:
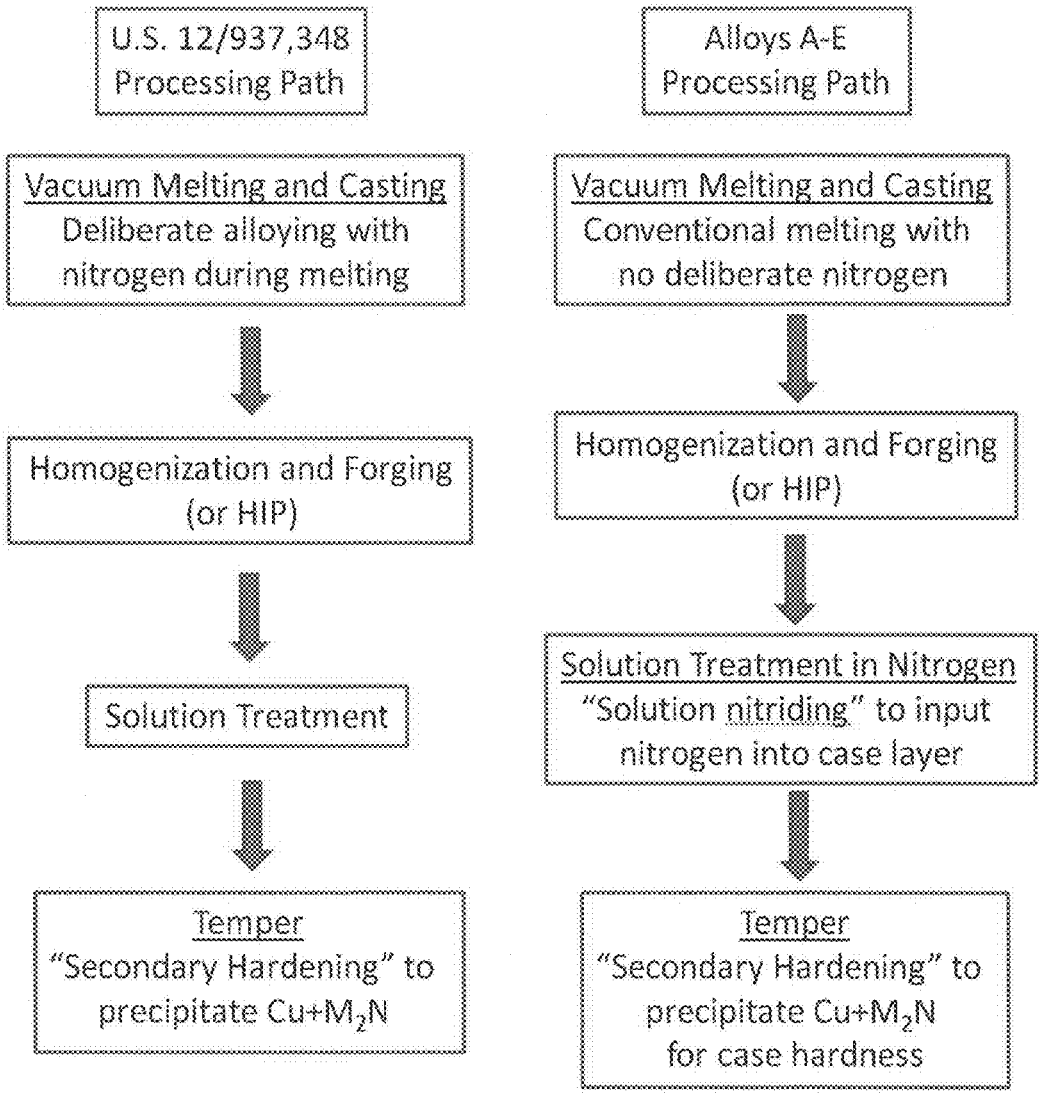
FIG. 5 is a graphical description of the processing used to alloys A-E compared to the process employed in U.S. patent application Ser. No. 12/937,348.

A graphical description of the processing used to create the case hardened alloys A-E compared to the process employed in U.S. patent application Ser. No. 12/937,348 is set forth in FIG. 5.

Microstructure analysis of the alloys results in a case hardened martensitic phase comprising at least about 90% by volume and typically in the range of 95% to 100% with a case thickness dependent upon the conditions of the nitriding process (in the range of 0.5 mm to 2 mm in the embodiments disclosed here).

Figure 3:
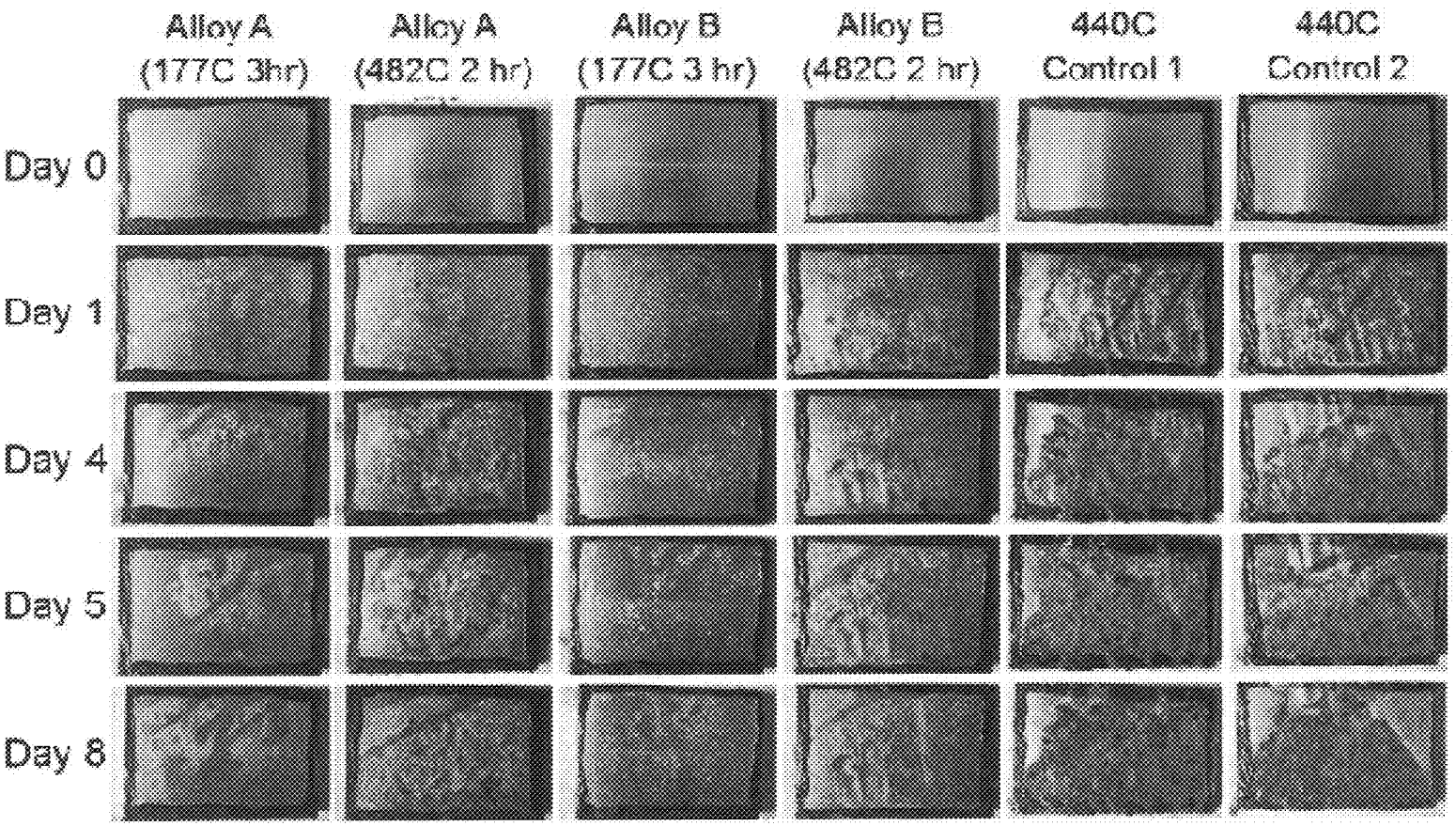
FIG. 3 is a series of pictures showing the results of salt fog testing of alloys A and B in comparison to the commercial alloy 440C.

Corrosion testing was conducted on alloys A and B. Corrosion testing was completed per ASTM B117 standards. Samples were heat treated to Stage I and Stage IV temper conditions, surface ground to a clean finish, passivated per AMS 2700 Method 1 Type 6 (passivated for 80 minutes at room temperature in a 50% nitric acid solution), then baked at 375° F. for 4 hours followed by air cooling. Samples were exposed to a sodium chloride salt fog solution per ASTM B117 for 8 days, with visual inspections at 1 day, 4 days, 5 days and 8 days of exposure. The salt fog testing (FIG. 3) demonstrated that alloys A and B possess superior corrosion resistance in comparison to the commercial alloy 440C, as shown in FIG. 3.

Figure 4:
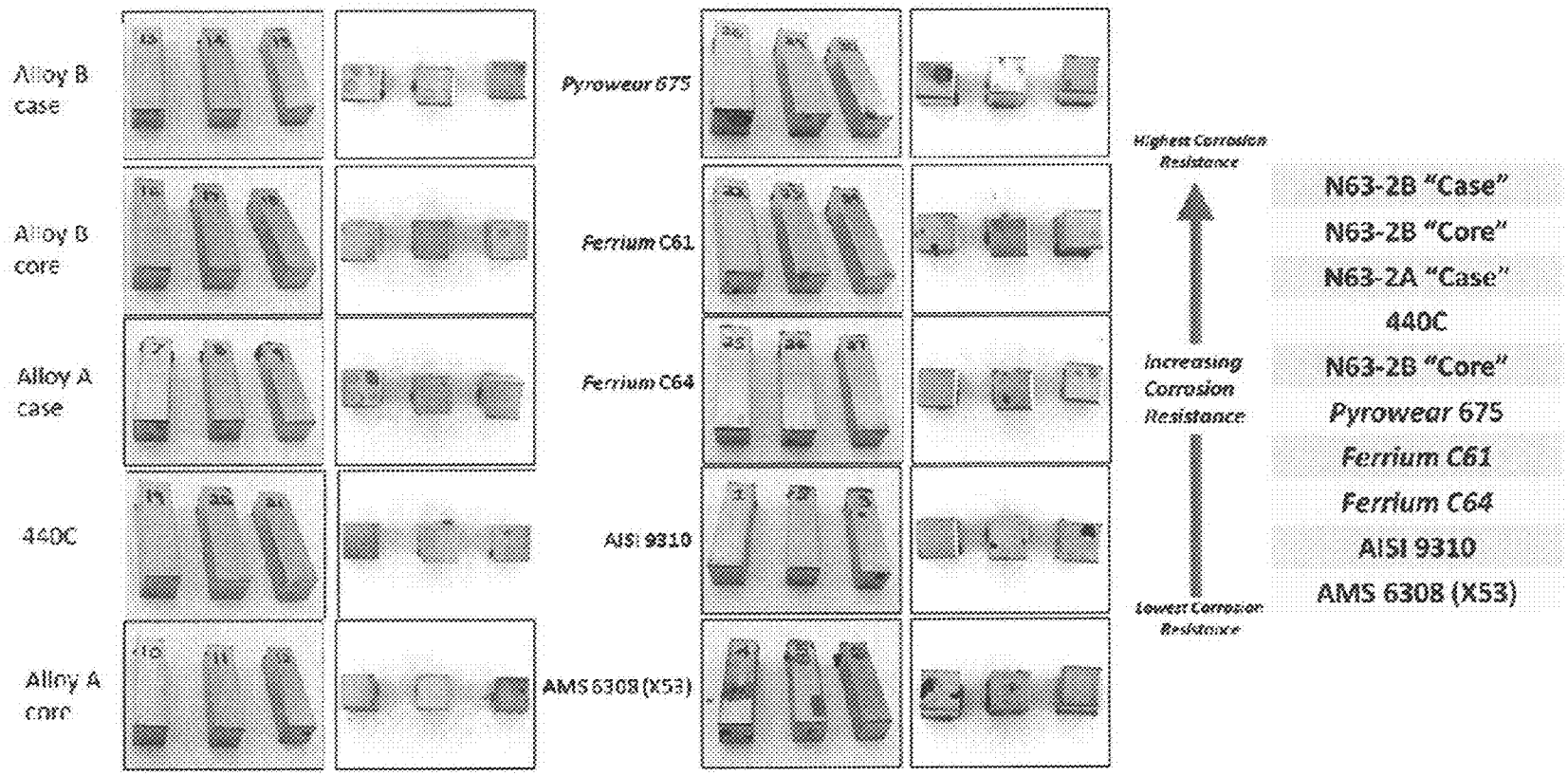
FIG. 4 is a picture showing the results of mild corrosion testing of Alloys A and B in comparison to a variety of commercial alloys.

In addition, a mild corrosion test also shows that alloys A and B possess superior corrosion resistance in comparison to a variety of commercial alloys, as shown in FIG. 4.

The various embodiments of martensitic stainless steels disclosed herein provide benefits and advantages over existing steels, including existing secondary-hardened carbon stainless steels or conventional nitride-strengthened steels. For example, the disclosed steels provide a substantially increased strength and avoid embrittlement under impact loading, at attractively low material and process costs. Additionally, cementite formation in the alloy is minimized or substantially eliminated, which avoids undesirable properties that can be created by cementite formation. Accordingly, the disclosed stainless steels may be suitable for gear wheels where high, strength and toughness are desirable to improve power transmission. Other benefits and advantages are readily recognizable to those skilled in the art.

It is understood that the disclosure may embody other specific forms without departing from the spirit or central characteristics thereof. The disclosure of aspects and embodiments, therefore, are to be considered in all respects as illustrative and not restrictive, and the claims are not to be limited to the details given herein. Accordingly, while specific embodiments have been illustrated and described, numerous modifications come to mind without significantly departing from the spirit of the invention and the scope of protection is only limited by the scope of the accompanying claims. Unless noted otherwise, all percentages listed herein are weight percentages.

For reasons of completeness, various aspects of the present disclosure are set out in the following numbered clauses:

Clause 1. An alloy comprising, by weight, about 11.5% to about 14.5% chromium, about 0.1% to about 3.0% nickel, about 0.1% to about 1.0% copper, about 0.1% to about 0.3% carbon, about 0.01% to about 0.1% niobium, 0% to about 5% cobalt, 0% to about 3.0% molybdenum, and 0% to about 0.5% titanium, the balance essentially iron and incidental elements and impurities.

Clause 2. The alloy of clause 1, wherein the alloy comprises, by weight, about 12.0% to about 14.1% chromium, about 0.3% to about 1.7% nickel, about 0.2% to about 0.5% copper, about 0.1% to about 0.2% carbon, about 0.04% to about 0.06% niobium, 0% to about 3.0% cobalt, 0% to about 1.5% molybdenum, and 0% to about 0.1% titanium, the balance essentially iron and incidental elements and impurities.

Clause 3. The alloy of clause 1, wherein the alloy has nitrogen solubility of about 0.25% to about 0.40%.

Clause 4. The alloy of clause 3, wherein the alloy has a ratio of nitrogen to carbon, by weight, of 1.5 to 3.5.

Clause 5. The alloy of clause 4, wherein the sum of the nitrogen and carbon content of the alloy is, by weight, about 0.35% to about 0.65%.

Clause 6. The alloy of any of clauses 1-5, wherein the alloy has a core δ-ferrite solvus temperature of at least 1180° C.

Clause 7. The alloy of any of clauses 1-5, wherein the alloy has a case martensite start temperature of at least 145° C.

Clause 8. The alloy of any of clauses 1-5, wherein the alloy has a case hardness of at least 60 HRC, measured according to ASTM E384 and ASTM E140.

Clause 9. The alloy of any of clauses 1-5, wherein the alloy has a case hardness of at least 52 HRC at a depth of 0.02 inches, measured according to ASTM E384 and ASTM E140.

Clause 10. The alloy of any of clauses 1-5, wherein the alloy has an ultimate tensile strength of at least 180 ksi, measured according to ASTM E8.

Clause 11. The alloy of any of clauses 1-5, wherein the alloy has a 0.2% offset yield strength of at least 140 ksi, measured according to ASTM E8.

Clause 12. The alloy of any of clauses 1-5, wherein the alloy has a percent elongation of at least 15%, measured according to ASTM E8.

Clause 13. The alloy of any of clauses 1-5, wherein the alloy has a tensile reduction in area of at least 55%, measured according to ASTM E8.

Clause 14. The alloy of any of clauses 1-5, wherein the alloy has a fracture toughness of at least 50 $ksi*in^{1/2}$, measured according to ASTM E399.

Clause 15. The alloy of any of clauses 1-5, wherein the alloy is corrosion resistant in a salt fog corrosion test, measured according to ASTM B117.

Clause 16. The alloy of any of clauses 1-5, wherein the alloy comprises a grain pinning dispersion of MC carbide particles, or a combination thereof; wherein M, at each occurrence, is independently selected from the group consisting of niobium and titanium.

Clause 17. The alloy of any of clauses 1-5, wherein the alloy comprises precipitates of a bcc-copper phase and nitride precipitates enriched with transition metals.

Clause 18. The alloy of clause 17, wherein the nitride precipitates nucleate on the bcc-copper phase, and comprise at least one metal selected from the group consisting of chromium, molybdenum, vanadium, and iron.

Clause 19. The alloy of any of clauses 1-5, wherein the average grain width of the alloy is 10 microns to 100 microns, measured according to ASTM E112.

Clause 20. The alloy of any of clauses 1-19, wherein the alloy comprises about 12.4% chromium, about 1.4% nickel, about 0.3% copper, about 0.14% carbon, about 0.05% niobium, about 2.8% cobalt, about 1.5% molybdenum, and about 0.006% titanium.

Clause 21. The alloy of any of clauses 1-19, wherein the alloy comprises 12.0% chromium, about 1.7% nickel, about 0.3% copper, about 0.2% carbon, about 0.04% niobium, about 1.5% molybdenum, and about 0.01% titanium.

Clause 22. The alloy of any of clauses 1-19, wherein the alloy comprises 12.9% chromium, about 1.3% nickel, about 0.4% copper, about 0.1% carbon, about 0.05% niobium, about 3.0% cobalt, about 1.3% molybdenum, and about 0.008% titanium.

Clause 23. The alloy of any of clauses 1-19, wherein the alloy comprises 13.9% chromium, about 1.2% nickel, about 0.3% copper, about 0.12% carbon, about 0.05% niobium, about 3.0% cobalt, about 0.9% molybdenum, and about 0.02% titanium.

Clause 24. The alloy of any of clauses 1-19, wherein the alloy comprises 14.1% chromium, about 0.4% nickel, about 0.3% copper, about 0.14% carbon, about 0.04% niobium, about 1.6% cobalt, about 0.02% molybdenum, and about 0.01% titanium.

Clause 25. A method for producing an alloy comprising: preparing a melt that includes, by weight, about 11.5% to about 14.5% chromium, about 0.1% to about 3.0% nickel, about 0.1% to about 1.0% copper, about 0.1% to about 0.3% carbon, about 0.01% to about 0.1% niobium, 0% to about 5% cobalt, 0% to about 3.0% molybdenum, and 0% to about 0.5% titanium, the balance essentially iron and incidental elements and impurities Clause 26. The method of clause 25, wherein the alloy comprises, by weight, about 12.0% to about 14.1% chromium, about 0.3% to about 1.7% nickel, about 0.2% to about 0.5% copper, about 0.1% to about 0.2% carbon, about 0.04% to about 0.06% niobium, 0% to about 3.0% cobalt, 0% to about 1.5% molybdenum, and 0% to about 0.1% titanium, the balance essentially iron and incidental elements and impurities.

Clause 27. The method of clause 25, wherein the melt is produced by Vacuum Induction Melting (VIM) followed by Vacuum Arc Remelting (VAR) into ingots.

Clause 28. The method of clause 27, further comprising: homogenizing the ingots at 1100° C. for 24 hours; homogenizing the ingots at 1150° C. for 24 hours; hot rolling the ingots at 1150° C. into plates of specified thickness; normalizing the hot rolled plates at 1000° C. for 1 hour; treating the hot rolled plates with cooling air; annealing at 625° C. for 8 hours; and cooling to room temperature in air.

Clause 29. The method of clause 28, further comprising: subjecting the plates to an isothermal aging treatment at temperatures in the range of 420° C. to 496° C. for up to 32 hours.

Clause 30. The method of clause 25, further comprising solution nitriding at 1100° C.

Clause 31. The method of clause 25, wherein the alloy has nitrogen solubility of about 0.25% to about 0.4%.

Clause 32. The method of clause 25, wherein the alloy has a ratio, by weight, of nitrogen to carbon of 1.5 to 3.5.

Clause 33. The method of clause 25, wherein the sum of the nitrogen and carbon content of the alloy is, by weight, about 0.35% to about 0.65%.

Clause 34. The method of clause 25, wherein the alloy has a core δ-ferrite solvus temperature of at least 1180° C.

Clause 35. The method of clause 25, wherein the alloy has a case martensite start temperature of at least 145° C.

Clause 36. The method of clause 25, wherein the alloy has a case hardness of at least 60 HRC, measured according to ASTM E384 and ASTM E140.

Clause 37. The method of clause 25, wherein the alloy has a case hardness of at least 52 HRC at a depth of 0.02 inches, measured according to ASTM E384 and ASTM E140.

Clause 38. The method of clause 25, wherein the alloy has an ultimate tensile strength of at least 200 ksi, measured according to ASTM E8.

Clause 39. The method of clause 25, wherein the alloy has a 0.2% offset yield strength of at least 160 ksi, measured according to ASTM E8.

Clause 40. The method of clause 25, wherein the alloy has a percent elongation of at least 20%, measured according to ASTM E8.

Clause 41. The method of clause 25, wherein the alloy has a tensile reduction in area of at least 70%, measured according to ASTM E8.

Clause 42. The method of clause 25, wherein the alloy has a fracture toughness of at least 50 $ksi*in^{1/2}$, measured according to ASTM E399.

Clause 43. The method of clause 25, wherein the alloy is corrosion resistant in a salt fog corrosion test, measured according to ASTM B117.

Clause 44. The method of clause 25, wherein the alloy comprises precipitates of a bcc-copper phase and nitride precipitates enriched with transition metals.

Clause 45. The method of clause 44, wherein the nitride precipitates nucleate on the bcc-copper phase, and comprise at least one metal selected from the group consisting of chromium, molybdenum, vanadium, and iron.

Clause 46. The method of clause 25, wherein the alloy comprises a grain pinning dispersion of MC particles, or a combination thereof; wherein M, at each occurrence is independently selected from the group consisting of niobium and titanium.

Clause 47. The method of clause 25, wherein the average grain width of the alloy is 10 microns to 100 microns, measured according to ASTM E112.

Clause 48. A manufactured article comprising an alloy that includes, by weight, about 11.5% to about 14.5% chromium, about 0.1% to about 3.0% nickel, about 0.1% to about 1.0% copper, about 0.1% to about 0.3% carbon, about 0.01% to about 0.1% niobium, 0% to about 5% cobalt, 0% to about 3.0% molybdenum, and 0% to about 0.5% titanium, the balance essentially iron and incidental elements and impurities.

Clause 49. The article of clause 48, wherein the alloy comprises, by weight, about 12.0% to about 14.1% chromium, about 0.3% to about 1.7% nickel, about 0.2% to about 0.5% copper, about 0.1% to about 0.2% carbon, about 0.04% to about 0.06% niobium, 0% to about 3.0% cobalt, 0% to about 1.5% molybdenum, and 0% to about 0.1% titanium, the balance essentially iron and incidental elements and impurities.

Clause 50. The article of clause 48, wherein the alloy has nitrogen solubility of about 0.25% to about 0.40%.

Clause 51. The article of clause 48, wherein the alloy has a ratio of nitrogen to carbon, by weight, of 1.5 to 3.5.

Clause 52. The article of clause 48, wherein the sum of the nitrogen and carbon content of the alloy is, by weight, about 0.35% to about 0.65%.

Clause 53. The article of clause 48, wherein the alloy has a core δ-ferrite solvus temperature of at least 1180° C.

Clause 54. The article of clause 48, wherein the alloy has a case martensite start temperature of at least 145° C.

Clause 55. The article of clause 48, wherein the alloy has a case hardness of at least 60 HRC, measured according to ASTM E384 and ASTM E140.

Clause 56. The article of clause 48, wherein the alloy has a case hardness of at least 52 HRC at a depth of 0.02 inches, measured according to ASTM E384 and ASTM E140.

Clause 57. The article of clause 48, wherein the alloy has an ultimate tensile strength of at least 200 ksi, measured according to ASTM E8.

Clause 58. The article of clause 48, wherein the alloy has a 0.2% offset yield strength of at least 160 ksi, measured according to ASTM E8.

Clause 59. The article of clause 48, wherein the alloy has a percent elongation of at least 20%, measured according to ASTM E8.

Clause 60. The article of clause 48, wherein the alloy has a tensile reduction in area of at least 70%, measured according to ASTM E8.

Clause 61. The article of clause 48, wherein the alloy has a fracture toughness of at least 50 ksi*in$^{1/2}$, measured according to ASTM E399.

Clause 62. The article of clause 48, wherein the alloy is corrosion resistant in a salt fog corrosion test, measured according to ASTM B117.

Clause 63. The article of clause 48, wherein the alloy comprises precipitates of a bcc-copper phase and nitride precipitates enriched with transition metals.

Clause 64. The article of clause 63, wherein the nitride precipitates nucleate on the bcc-copper phase, and comprise at least one metal selected from the group consisting of chromium, molybdenum, vanadium, and iron.

Clause 65. The article of clause 48, wherein the alloy comprises of a grain pinning dispersion of MC particles; wherein M, at each occurrence, is independently selected from the group consisting of niobium and titanium.

Clause 66. The article of clause 48, wherein the average grain size of the alloy is 10 microns to 100 microns, measured according to ASTM E112.

Clause 67. The article of clause 48, wherein the article is at least one of an aircraft engine bearing, or a lift fan gearbox bearing.

Clause 68. A case hardened martensitic stainless steel alloy strengthened by copper-nucleated nitride precipitates, said alloy comprising, in combination by weight percent, about 10.0 to about 14.5 Cr, about 0.3 to about 7.5 Ni, Co up to about 17.0 Co, about 0.6 to about 1.5 Mo, about 0.25 to about 2.3 Cu, up to about 0.6 Mn, up to about 0.4 Si, about 0.05 to about 0.15 V, up to about 0.10 N, C up to about 0.2 C, up to about 0.01 W, and the balance Fe and incidental elements and impurities, said alloy having a microstructure substantially free of cementite carbides and comprising a martensite matrix with nanoscale copper particles and alloy nitride precipitates selected from the group consisting of alloy nitride precipitates enriched with a transition metal nucleated on the copper precipitates, said alloy nitride precipitates having a hexagonal structure, said alloy nitride precipitates including one or more alloying elements selected from the group Fe, Ni, Cr, Co and Mn coherent with the matrix, and said alloy nitride precipitates having two dimensional coherency with the matrix, said alloy substantially free of cementite carbide precipitates the form of a case hardened article of manufacture.

Clause 69. The alloy of clause 68, wherein the alloy has a core tensile yield strength of about 150 to 175 ksi, a core ultimate strength of about 190 to 225 ksi and a fracture toughness of about 50 to 115 ksi*in$^{1/2}$.

Clause 70. The alloy of clause 68, wherein the alloy has a martensite start temperature of at least about 50° C.

Clause 71. The alloy of clause 68, wherein the alloy comprises precipitates of a copper-based phase and nitride precipitates enriched with transition metals.

Clause 72. The alloy of clause 68, wherein the nitride precipitates nucleate on the copper-based phase, and comprise at least one metal selected from the group consisting of chromium, molybdenum, and vanadium.

Clause 73. The alloy of clause 68, wherein the alloy has a case hardness greater than about 59 HRC.

Clause 74. The alloy of clause 73, wherein said case includes at least about 90% of by volume martensitic matrix.

Clause 75. The alloy of clause 68, wherein the N to C ratio is in the range of about 2 to 10.

What is claimed is:

1. A method for preparing a martensitic, stainless steel case hardened alloy strengthened by copper nucleated nitride precipitates, said alloy comprising the following constituents in combination by weight percent, about 11.5 to about 14.5 Cr, about 0.1 to about 3.0 Ni, about 0.1 to about 1.0 Cu, about 0.1 to about 0.3 C, up to about 0.4 N, about 0.01 to about 0.1 Nb, 0 to about 5.0 Co, up to about 3 Mo, up to about 0.5 Ti, and the balance Fe and incidental elements and impurities, said alloy having a microstructure comprising a martensite matrix with nanoscale copper particles and alloy nitride precipitates selected from the group consisting of alloy nitride precipitates enriched with a transition metal nucleated on the copper precipitates, said alloy nitride precipitates having a hexagonal structure, said alloy nitride precipitates including one or more alloying elements selected from the group consisting of Fe, Ni, Cr, Co and Mo coherent with the matrix, said alloy nitride precipitates having two dimensional coherency with the matrix and said alloy substantially free of cementite carbide precipitates, said method comprising the steps of:

(a) preparing a melt of said aforesaid constituents substantially absent N;

(b) casting a form from said melt;

(c) optionally homogenizing the form;

(d) optionally working the form; and (e) solution nitriding the form to effect the microstructure.

2. A martensite, stainless steel case hardened alloy strengthened by copper nucleated nitride precipitates selected from the group consisting of:

an alloy comprising about 12.4% chromium, about 1.4% nickel, about 0.3% copper, about 0.14% carbon, 0.29% N, about 0.05% niobium, about 2.8% cobalt, about 1.5% molybdenum, and about 0.006% titanium, and the balance iron and incidental elements and impurities;

an alloy comprising about 12.0% chromium, about 1.7% nickel, about 0.3% copper, about 0.2% carbon, about 0.33% N, about 0.04% niobium, about 1.5% molybdenum, and about 0.01% titanium, and the balance iron and incidental elements and impurities;

an alloy comprising about 12.9% chromium, about 1.3% nickel, about 0.4% copper, about 0.1% carbon, about 0.3% N, about 0.05% niobium, about 3.0% cobalt, about 1.3% molybdenum, and about 0.008% titanium, and the balance iron and incidental elements and impurities;

an alloy comprising about 13.9% chromium, about 1.2% nickel, about 0.3% copper, about 0.12% carbon, about 0.36% N, about 0.05% niobium, about 3.0% cobalt, about 0.9% molybdenum, and about 0.02% titanium, and the balance iron and incidental elements and impurities;

an alloy comprising about 14.1% chromium, about 0.4% nickel, about 0.3% copper, about 0.14% carbon, about 0.36% nitrogen, about 0.04% niobium, about 1.6% cobalt, about 0.02% molybdenum, and about 0.01% titanium;

each said alloy having a microstructure comprising a martensite matrix with nanoscale copper particles and alloy nitride precipitates enriched with a transition metal nucleated on the copper precipitates, said alloy nitride precipitates having a hexagonal structure, said alloy nitride precipitates including alloying elements selected from the group consisting of Cr, Co and Mo coherent with the matrix, said alloy nitride precipitates having two dimensional coherency with the matrix and said alloy substantially free of cementite carbide precipitates.

3. An alloy of claim 2, wherein the alloy has a core δ-ferrite solvus temperature of at least 1180° C.

4. An alloy of claim 2, wherein the alloy has a case martensite start temperature of about 140° C. to 300° C.

* * * * *